US009810000B2

(12) United States Patent
Schroeder

(10) Patent No.: US 9,810,000 B2
(45) Date of Patent: Nov. 7, 2017

(54) ELECTRONIC LOCKING APPARATUS FOR A ROLLUP DOOR

(71) Applicant: JANUS INTERNATIONAL GROUP, LLC, Temple, GA (US)

(72) Inventor: Curtis Leon Schroeder, Carrollton, GA (US)

(73) Assignee: JANUS INTERNATIONAL GROUP, LLC, Temple, GA (US)

( * ) Notice: Subject to any disclaimer, the term of this patent is extended or adjusted under 35 U.S.C. 154(b) by 0 days.

(21) Appl. No.: 15/259,801

(22) Filed: Sep. 8, 2016

(65) Prior Publication Data

US 2017/0067271 A1 Mar. 9, 2017

Related U.S. Application Data

(60) Provisional application No. 62/215,580, filed on Sep. 8, 2015.

(51) Int. Cl.

| | |
|---|---|
| ***E05B 65/06*** | (2006.01) |
| ***E05B 47/00*** | (2006.01) |
| ***E05B 9/02*** | (2006.01) |
| ***E05B 15/02*** | (2006.01) |
| ***E05C 3/12*** | (2006.01) |
| ***E05B 65/00*** | (2006.01) |

(52) U.S. Cl.

CPC ..... *E05B 47/0004* (2013.01); *E05B 9/02* (2013.01); *E05B 15/0295* (2013.01); *E05B 65/0021* (2013.01); *E05B 65/06* (2013.01); *E05C 3/12* (2013.01); *E05B 2047/0069* (2013.01)

(58) Field of Classification Search

CPC ..... E05B 47/0004; E05B 65/0021; E05B 15/0295; E05B 9/02; E05B 65/06; E05B 2047/0069; E05C 3/12

See application file for complete search history.

(56) References Cited

U.S. PATENT DOCUMENTS

| | | | | |
|---|---|---|---|---|
| 3,996,591 | A * | 12/1976 | Hayward | E05B 47/0012 292/144 |
| 5,852,944 | A | 12/1998 | Collard, Jr. et al. | |
| 8,789,859 | B2 | 7/2014 | Curtis et al. | |
| 2004/0061597 | A1 | 4/2004 | Thompson | |
| 2005/0235711 | A1 | 10/2005 | Martin et al. | |

(Continued)

OTHER PUBLICATIONS

Search Report and Written Opinion from International Application No. PCT/US2016/050736; dated Nov. 15, 2016.

*Primary Examiner* — Jerry Redman

(74) *Attorney, Agent, or Firm* — Barnes & Thornburg LLP; Jason Bernstein

(57) ABSTRACT

A locking apparatus for a rollup door, comprising latch assembly including a latch, a release lever, a trigger, a cam and a solenoid. A housing that houses the latch assembly includes at least one opening that can removably receive a door striker member. The latch assembly includes a locked/unlocked status limit switch for detecting when the latch assembly is in an unlocked or locked position and an open/closed status limit switch for detecting when the striker member is disengaged from the latch assembly and door is (or can be) open or closed. The locking apparatus can be electronically unlocked or it can be unlocked manually by a user by actuating the solenoid which causes the latch to release the locked striker member.

6 Claims, 31 Drawing Sheets

(56) References Cited

U.S. PATENT DOCUMENTS

| | | | | |
|---|---|---|---|---|
| 2014/0319851 | A1 | 10/2014 | Curtis et al. | |
| 2015/0097380 | A1* | 4/2015 | Nye-Hingston | E05B 63/14 292/201 |
| 2017/0051536 | A1* | 2/2017 | Chang | E05B 65/1053 |
| 2017/0067271 | A1* | 3/2017 | Schroeder | E05B 47/0004 |

* cited by examiner

ELECTRONIC LOCKING APPARATUS FOR A ROLLUP DOOR

CROSS-REFERENCE TO RELATED APPLICATION

This application claims benefit of U.S. provisional patent application No. 62/215,580, filed Sep. 8, 2015, entitled ELECTRONIC LOCKING APPARATUS FOR A ROLLUP DOOR, and commonly assigned to the assignee of the present application, the disclosure of which is incorporated by reference in its entirety herein.

FIELD

The present disclosure relates to locking apparatus and, in exemplary embodiments, to electronic locking apparatus for rollup or overhead doors.

BACKGROUND

FIG. 1 shows a conventional rollup door 10 (also known as an overhead door) system which typically includes first and second opposing vertical guide tracks 12, 14 which are mounted in the doorway opening. A rollup door 16 typically has a curtain 18 made of a number of connected sheets which move within the guide tracks. A bottom bar base member 20 comprising an elongated bar is at the bottom of the curtain 18. The bottom bar 20 may comprise an L-shape in cross-section having a vertical section 22 and a horizontal section 24. The bar typically has a rope 26 for manual raising and lowering from the coil side. Brackets support the door 16 and utilize a tension wheel 28 and/or associated drive mechanism (not shown) for manual and/or motor driven moving the door. A conventional door lock mechanism typically has a sliding lock bar 32 mounted to the curtain 18 and either an aperture 30 in one or both of the guide tracks 12 or 14 or a striker plate having an aperture and mounted to one of the guide tracks. When the door 16 is positioned for locking, the sliding lock bar 32 slides into the aperture 30 and the door 16 is maintained in relative position until the mechanism is unlocked. A lock, such as a combination or key lock, is manually attached to the locking bar (either directly or indirectly) to prevent unlocking by anyone other than the intended user. A sectional door, most commonly found in residential garages, comprises a set of sections which have a number of guide rollers mounted on axles which roll within the guide tracks.

One problem with such manual sliding lock systems is that the locking mechanism relies on the tenant providing an external lock which is necessarily accessible by anyone from outside of the storage unit, and which can be cut by a burglar with a bolt cutter. Another problem with a manual locking system is that if the tenant loses the key a bolt cutter is needed to be able to unlock the door. Also, in the event that a tenant fails to pay rent, the facility manager typically must add an additional lock to the locking mechanism to prevent the tenant from accessing the storage unit until the rent is paid. However, the tenant can cut the facility's lock with a bolt cutter.

It would be desirable to have a rollup door security and locking system which would eliminate the need for externally accessible mechanical locks. It would be desirable for such a system to permit remote control of access by a facility manager. It would be desirable for such a system to provide access to users by a user interface which would be more reliable than a conventional mechanical combination or key lock. It would also be desirable to have an electronic locking system that would have a manual release mechanism to allow a user to bypass the electronic lock system to manually release the door from the lock so that the door can be opened if there is a power failure.

SUMMARY

The present disclosure provides, in exemplary embodiments, a locking apparatus for remote control and/or monitoring of the locking and unlocking of a door, such as a rollup door.

In one exemplary embodiment, the present disclosure provides a locking apparatus, such as for a rollup door, and a generally fixed base member, wherein the locking apparatus comprises a striker member comprising a mounting portion and a latch-engaging section, the mounting portion being adapted for mounting to the door system base member; and, a latch assembly. In exemplary embodiments, the latch assembly comprises a housing comprising first and second opposing side members and at least one first opening defined in the housing adapted to receive at least a portion of the latch-engaging section. In exemplary embodiments, the latch assembly further comprises a latch comprising a body having a bore extending therethrough, a tab extending from the body, a first leg extending from the body and a second leg extending from the body, the space between the first and second legs defining a latch opening, the latch adapted to rotate about a first pin passing through the latch bore, wherein the latch is adapted to releasably engage a portion of the latch-engaging section between the first and second legs. The latch also includes a post associated with or extending from a first face of the latch. In exemplary embodiments, the latch assembly further comprises a release lever having a first arm portion, a second arm portion and a middle portion having a bore extending therethrough, the release adapted to rotate about a second pin passing through the release lever bore. In exemplary embodiments, the latch assembly further comprises a cam comprising a cam body having first side and a second side, an edge, a bore extending through the cam body, a nose portion, a tooth extending from the cam body edge, and a post extending from one side, the cam adapted to rotate about a third pin passing through the cam bore, wherein the cam nose is adapted to selectively engage the latch tab and the cam tooth is adapted to selectively engage the release lever first arm portion. In exemplary embodiments, the latch assembly further comprises a trigger comprising a body having a first portion with a bore extending therethrough and a second portion having a detent portion, the trigger adapted to rotate about the third pin passing through the trigger bore, wherein the detent portion is adapted to selectively engage the release lever first arm portion. In exemplary embodiments, the latch assembly further comprises a solenoid associated with the housing, the solenoid including an actuation member and a piston, wherein the piston is adapted to selectively contact the release lever second arm portion. In exemplary embodiments, the housing and the latch cooperate to restrict movement of the striker latch-engaging when the latch assembly is in a locked position so as to maintain the door in a locked position and to permit disengagement of the striker latch-engaging section when the latch assembly is in an unlocked position.

In exemplary embodiments, the locking apparatus includes an open-status limit switch which provides an indication whether the door is in a closed or open state, and a lock-status limit switch which provides an indication whether the locking apparatus in a locked or unlocked state. In exemplary embodiments, both limit switches include an internal resistor. In exemplary embodiments, one of the limit switches includes an internal resistor. The open-status limit switch is actuated by contact with the release lever. The lock-status switch is actuated by contact with the latch post.

In one exemplary embodiment, the present disclosure provides a locking apparatus for use with a movable object and a stationary object, the movable object including a striker member and a latch-engaging section, the locking apparatus comprising a latch assembly as described hereinabove. The housing and the latch cooperate to restrict movement of the striker latch-engaging when the latch assembly is in a locked position so as to maintain the movable object in a locked position with respect to the fixed object and to permit disengagement of the striker latch-engaging section when the latch assembly is in an unlocked position so as to permit movement of the movable object.

In exemplary embodiments, a control assembly is included, generally comprising a processor, switch, user interface, control panel and memory storage. The control assembly can provide a signal to the solenoid to cause it to fire actuate the release lever.

Other features will become apparent upon reading the following detailed description of certain exemplary embodiments, when taken in conjunction with the appended claims.

BRIEF DESCRIPTION OF THE DRAWINGS

The drawings disclose exemplary embodiments in which like reference characters designate the same or similar parts throughout the figures of which.

DETAILED DESCRIPTION

Figure 1:
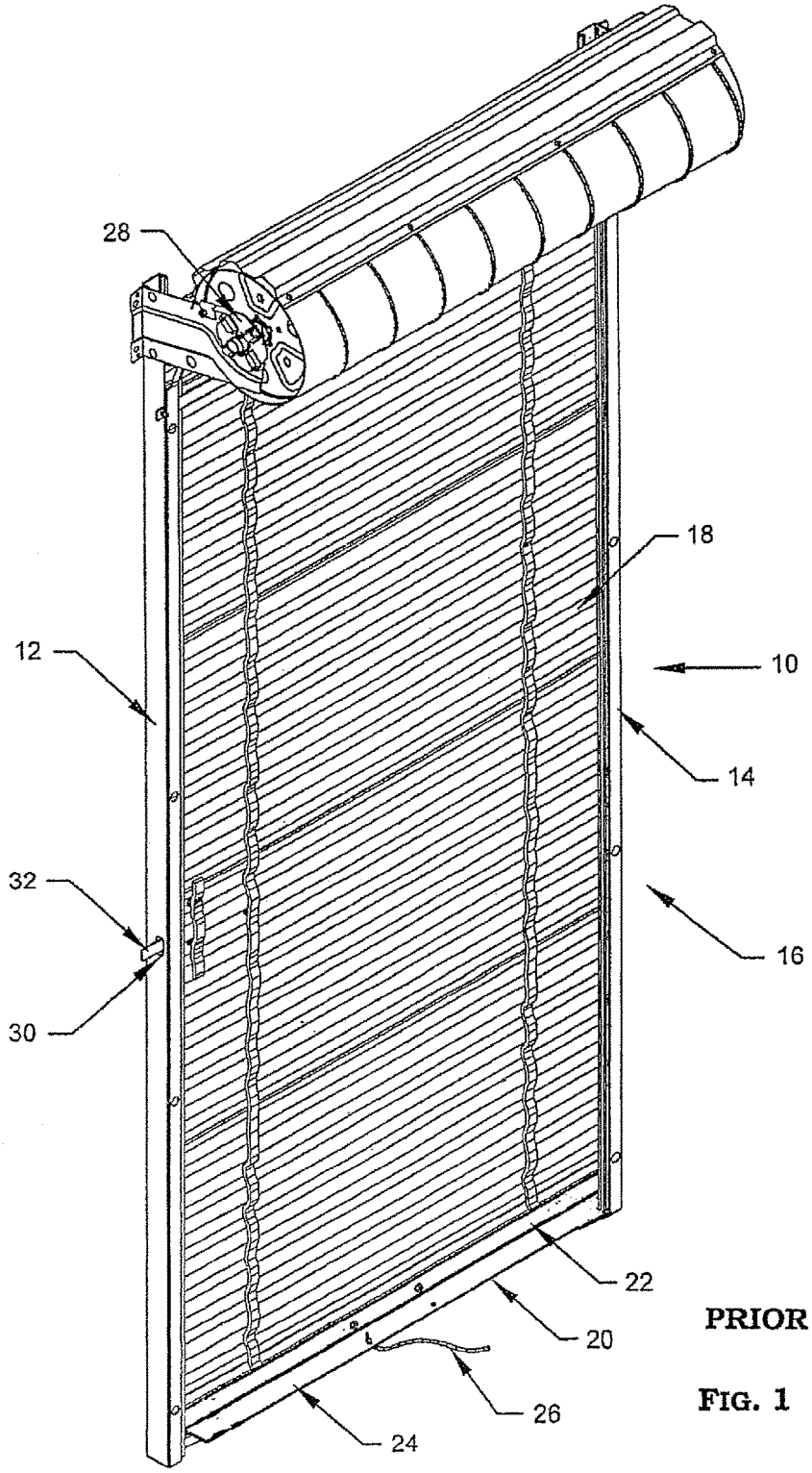
PRIOR ART FIG. 1
FIG. 1 (labeled "Prior Art") is a schematic perspective view of a conventional rollup door.

FIGS. 2-31 show various views and aspects of a first exemplary embodiment of a locking apparatus 50 for use with a door 16, such as a rollup door or other door system. It is to be understood that the locking apparatus 50 of the present disclosure can be used with doors other than rollup doors, such as, but not limited to, sectional doors, sliding doors, and the like, and can also be used or adapted for use in other environments which can benefit from a remote controlled locking and unlocking access system. Alternatively, the locking apparatus 50 can be used or adapted for use with lock and latch systems other than a door lock system. A rollup door will be discussed herein as one nonlimiting example. The door 16 includes a striker member 52. In exemplary embodiments, a locking apparatus 50 includes a latch assembly 54 and an electronic control assembly 300.

Figure 2:
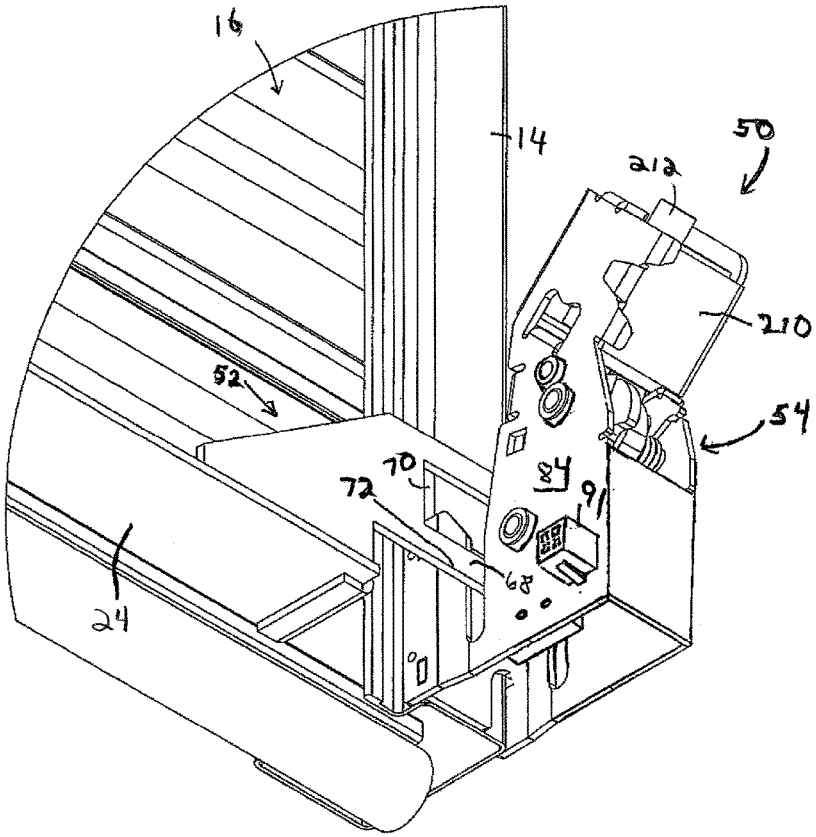
FIG. 2 is a perspective view of a first exemplary embodiment of a locking apparatus showing a first exemplary embodiment of a striker plate (mounted to a rollup door) engaged in a locked position with a first exemplary embodiment of a latch assembly.
Figure 3:
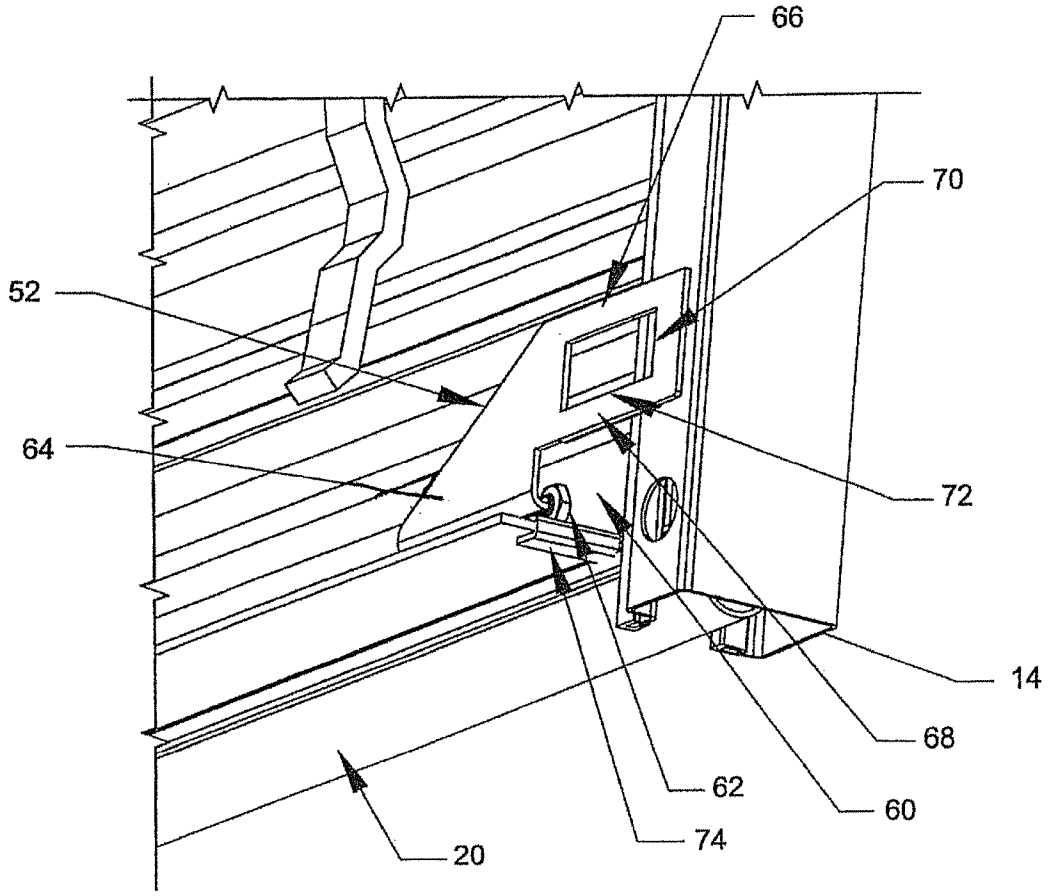
FIG. 3 is a perspective view of a detail showing the striker member according to one exemplary embodiment as attached to a rollup door.

FIG. 2 shows a perspective view of a first exemplary embodiment of a locking apparatus showing a first exemplary embodiment of a striker member 52 (mounted to a rollup door) engaged in a locked position with a first exemplary embodiment of a latch assembly 54. In exemplary embodiments, the striker member 52, shown in greater detail in FIG. 3, includes a mounting first portion 60 for attaching the striker member 52 to the door 16. The mounting portion 60 may have at least one hole 62 formed therein to permit mounting to the vertical section 22 of the door base member 20. Alternatively, the striker member 52 can be welded, adhered, or otherwise fixedly fastened to the door base member 20 or the area proximate thereto. The striker member 52 may further include a generally perpendicular second portion 64 which is generally parallel and proximate to the horizontal section of the door base member 20. The striker member 52 may further include a vertical third section 66 having a striker plate 68 extending therefrom, the striker plate having an opening 70 defined therein. The bottom edge portion 72 of the striker plate opening 70 optionally may be thicker than other portions of the striker member 52. In one exemplary embodiment, the second portion 64 optionally may have a generally U-shaped lip 74 which engages an end of the door base member horizontal section 24 to help maintain the striker member 52 in position.

The striker member 52 can be configured in different ways, as discussed further hereinbelow.

Figure 4:
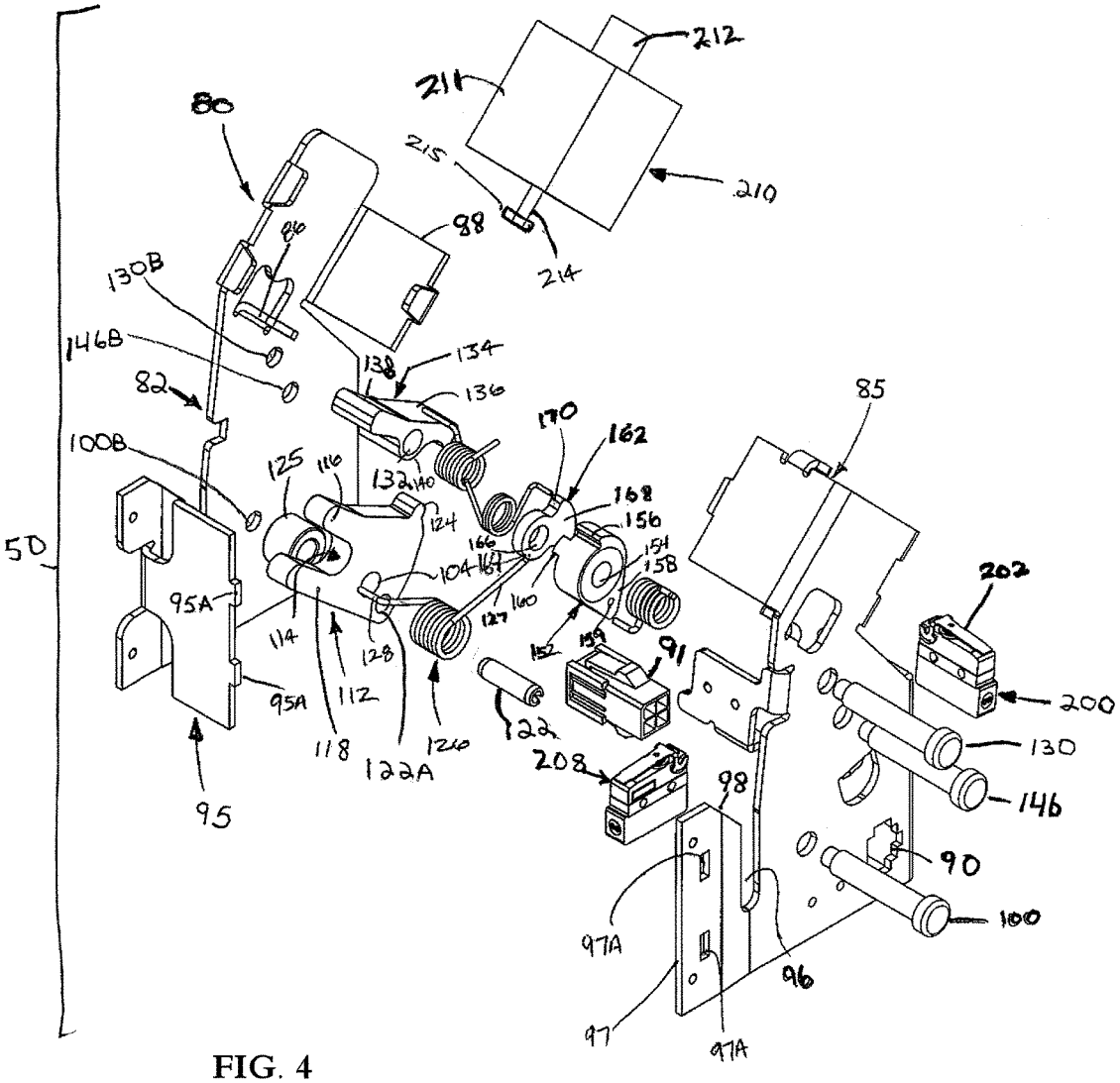
FIG. 4 is an exploded perspective view of a latch assembly according to one exemplary embodiment.

FIG. 4 shows an exploded view of one exemplary embodiment of a latch assembly 54 which includes include a housing 80 having opposing side members which, in exemplary embodiments, comprise a first side plate 82 and a second side plate 84. In exemplary embodiments, the housing may further comprise a receptacle 85 a base portion 86 and a rear portion 88 for holding a solenoid (discussed in detail hereinbelow). The second side plate 84 has an aperture 90 which can receive a female power connector 91 (for example, a Mini-Fit Jr.™ receptacle housing, commercially available from Molex, LLC (Lisle, Ill.)), which in turn can receive a male wiring harness (not shown). The connector 91 permits wires to be easily connected to the wiring harness during installation and avoids bare or unshielded wires from having to pass through the second side plate 84 and potentially touch the plate itself.

In exemplary embodiments, the open-status limit switch 208, lock-status limit switch 200, and solenoid 210 each have two wires associated therewith (not shown), namely, a ground wire and a hot wire. In exemplary embodiments, the ground wires from open-status limit switch 208, lock-status limit switch 200 and solenoid 210 can have a shared ground wire, reducing the total number of wires from six to four, thereby reducing the overall cost and the space needed.

In exemplary embodiments, the side plates 82, 84 may be connected to each other, such as, but not limited to, by a first connecting plate 95 extending from the side plate 82 that connects with a second connecting plate 97 extending from side plate 84. In exemplary embodiments, the connecting plate 95 may have one or more tabs 95A that can be inserted in corresponding slots 97A in the second side plate 84. In exemplary embodiments, the first and second side plates 82, 84 each have an opening, recess, gap, or the like which can receive a portion of the striker plate 68 when in the engaged position. In exemplary embodiments, the opening is a slot 96. In exemplary embodiments, each slot 96 may have a generally I-shaped, J-shaped or U-shaped opening. In an alternative exemplary embodiment, only one or the other of the side plates 82, 84 has a recess.

By way of illustration, but not limitation, a slot 96 will be discussed as an exemplary embodiment of a recess in the side plate or plates 82, 84. It is to be understood that in such discussion, while each side plate 82, 84 is shown as having a slot 96, it is possible for only one side plate to have the slot 96. One feature of having a slot 96 in each side plate 82, 84 is that the striker plate 68 can be positioned so as to slide into either or both slots 96 from either side of the latch assembly 54. Each slot 96 may have an area 98 near the opening of the slot 96, such as a beveled edge area in each of the side plates 82, 84, that is slightly wider than the rest of the width of the slot 96 to facilitate insertion of the striker plate 68. From a functional perspective, any shape for the slot 96 may be utilized that enables the striker plate 68 to be retained in the general area of the housing 80 with minimal horizontal movement (i.e., perpendicular to the vertical slots 96) when the striker plate 68 is in the locked position (as described in further detail hereinbelow). The housing 80 has an opening 99 formed therein bounded, in general, by the side plates 82, 84 and the connecting plate 95. In exemplary embodiments, it is into this opening 99 that at least a portion of the striker plate 68 can be inserted (and, in exemplary embodiments, further inserted into the slots 96).

Figure 5:
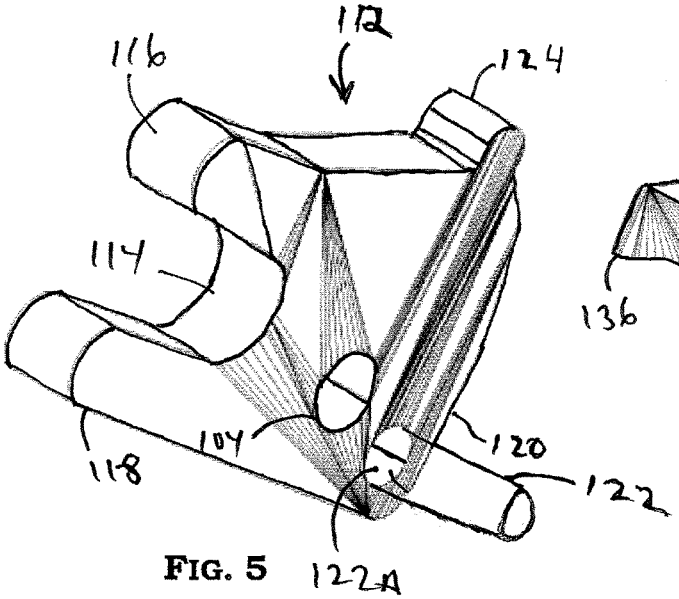
FIG. 5 is perspective view of one exemplary embodiment of a latch.

A first pin 100 is mounted between the two side plates 82, 84 and passes through apertures 100A (not shown), 100B in the side plates 82, 84, respectively. In exemplary embodiments, the first pin 100 may be a bolt, partially threaded screw, cotter pin or other structure that provides an axle-like support for rotation of one or more components associated with the pin. In exemplary embodiments, the first pin 100 may be a bolt having at least a portion of its distal end being threaded. A mating threaded nut 102 can secure the first pin 100 between the side plates 82, 84. The first pin 100 passes through a bore 104 in a latch 112. In exemplary embodiments, the latch 112 (a detail view of which is shown in FIG. 5) has a generally U-shaped opening 114 formed by a first leg 116 and a second leg 118 extending from a middle portion 120, the middle portion 120 having the bore 104 to receive the first pin 100. The middle portion 120 has a tab 124 extending from an edge. In exemplary embodiments, the first leg 116 may be shorter than the second leg 118. In exemplary embodiments, a post 122 is attached to an aperture 122A in the first face 123A and can contact the limit switch 200 (as described in further detail hereinbelow). In an alternative exemplary embodiment, the post 122 can be formed as an integral part of the latch 112. A spacer 125 is positioned proximate to the second face 123B. Alternatively, the spacer 125 may be formed as an integral part of the latch 112. A first spring 126 fits over the first pin 100 and has a first end 127 and second end 128. The first end 127 abuts the second side plate 84 and the second end 128 hooks over a portion of the latch 112.

A second pin 130, generally similar in construction options to the first pin 100 is mounted between the two side plates 82, 84 by means of aperture 130A (not shown), 130B in the side plates 82, 84, respectively, and maintained by a nut 131. In one exemplary embodiment of a locking apparatus 50 having a manual release feature, a release lever 134

Figure 6:
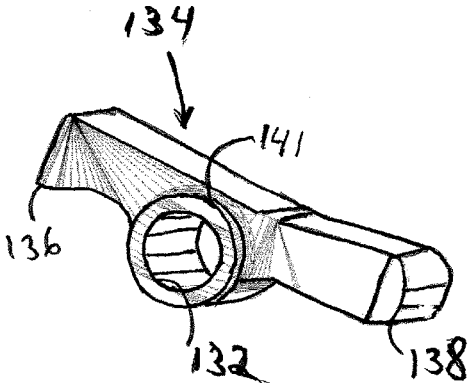
FIG. 6 is perspective view of one exemplary embodiment of a release lever.

(a detail view of which is shown in FIG. 6) comprises a first portion comprising a manual release arm 136, a second portion comprising a stop arm 138, and a middle portion 140 having a bore 132 extending therethrough. The second pin 130 passes through the bore 132. An integrated spacer 141 extends from one face of side of the release lever 134 and can fit over the second pin 130. The second pin 130 passes through a second spring 143, which has a first end 144 and a second end 145. The first end 144 is associated with the first side plate 82 and the second end 145 is associated with the release lever 134.

Figure 7:
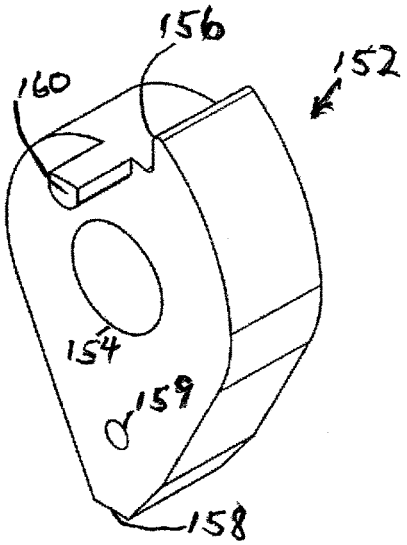
FIG. 7 is perspective view of one exemplary embodiment of a cam.
Figure 8:
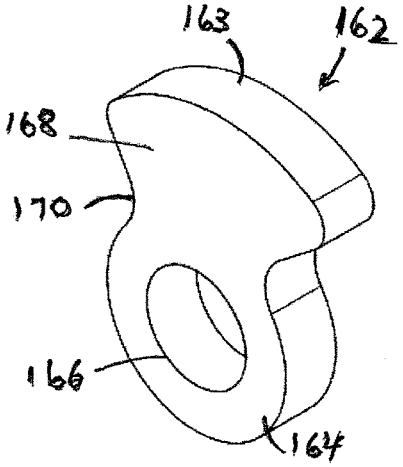
FIG. 8 is perspective view of one exemplary embodiment of a trigger.

A third pin 146, generally similar in construction options to the first pin 100, is mounted between the side plates 82, 84 via an aperture 146A (not shown), 146B in each side plate 82, 84, respectively, and maintained by a nut 148. A cam 152 (a detail view of which is shown in FIG. 7) has a bore 154 through which the third pin 146 passes. The cam 152 has a tooth 156 protruding from the edge and a nose portion 158, which may be generally opposite the tooth 156. The nose portion 158 may have an aperture 159 extending at least partially therethrough. A post 160 extends from one face of the cam 152 (generally parallel to the axis of the bore 154) proximate to the tooth 156. A trigger 162 (a detail view of which is shown in FIG. 8) has a curved edge 163 and has a first portion 164 having a bore 166 through which the third pin 146 passes. The trigger 162 also has a trigger body portion 168 that is flared, creating a detent portion 170.

A cam spring 180 is fitted over the third pin 146. The cam spring 180 has a first end 182 and a second end 184. The first end 182 is associated with the first side plate 82 and the second end 184 is associated with the cam aperture 159. A trigger spring 190 having an opening 191 is fitted over the third pin 146. The trigger spring 190 has a first end 192 and a second end 194. The first end 192 is associated with the trigger 162 and the second end 194 is associated with the second plate 84. Locking rotation of the cam 152 forces the trigger 162 rotation away from the release arm 134 by means of the cam post 160 contact with the trigger detent 170, which allows the release arm 134 to return to starting/locked position where the cam 152 and the trigger 162 are held in place via the cam tooth 156 and the trigger detent 170.

In exemplary embodiments, a lock-status limit switch 200 may be attached to the housing 80, as shown in FIG. 4. The lock-status limit switch 200 has a contact arm 202 that can be contacted by the release lever 134. The lock-status limit switch 200 is in electronic communication with a control assembly 300 (described in greater detail hereinbelow). The lock-status limit switch 200 can detect when the release lever stop arm 138 rotates and contacts the contact arm 202. Alternatively, instead of a limit switch, an optical, motion detection or other type of sensor known to those skilled in the art can be utilized.

Figure 18A:
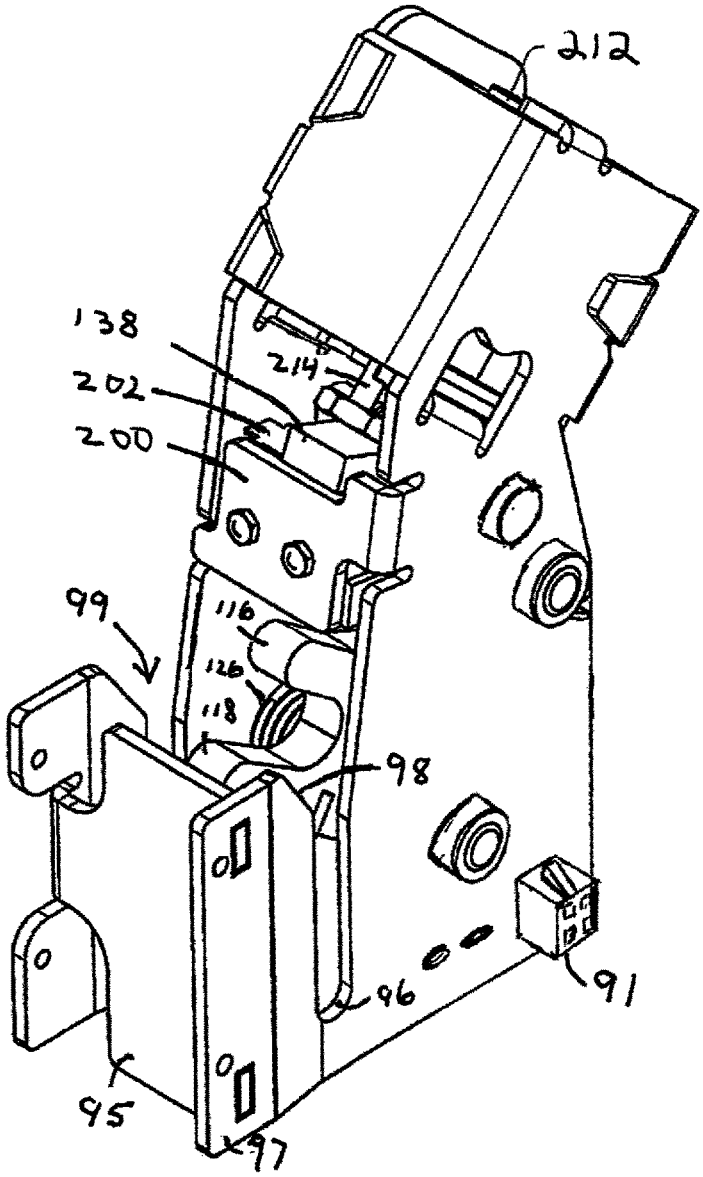
FIG. 18A is a right-rear perspective view showing the latch assembly of FIG. 2 in an unlocked position.
Figure 18B:
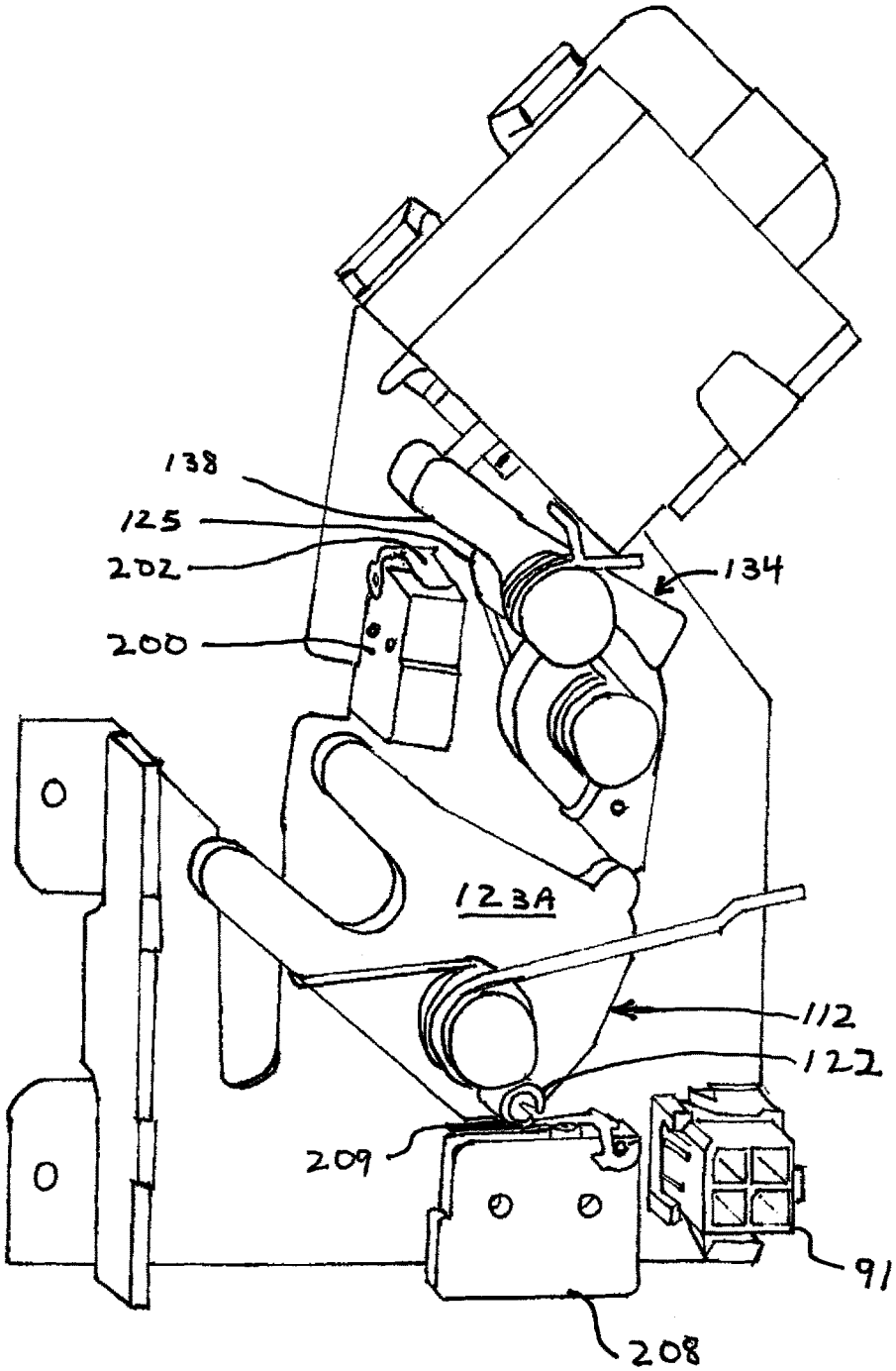
FIG. 18B is a right partial cutaway perspective view of the latch assembly of FIG. 18A.
Figure 19:
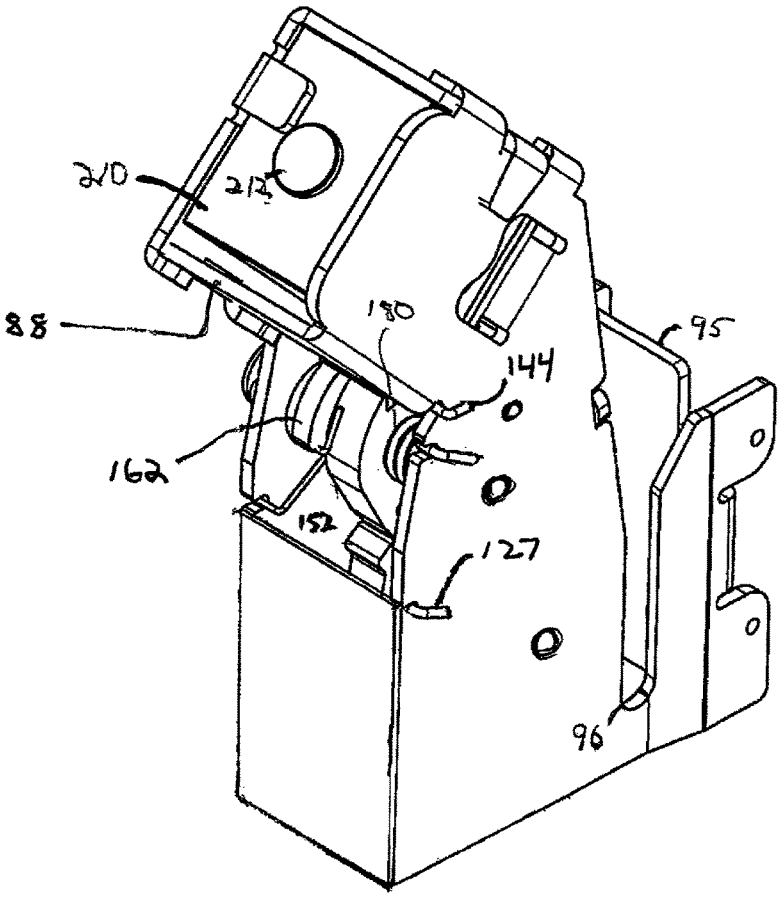
FIG. 19 is a right-front perspective view showing the latch assembly of FIG. 2 in an unlocked position.
Figure 20:
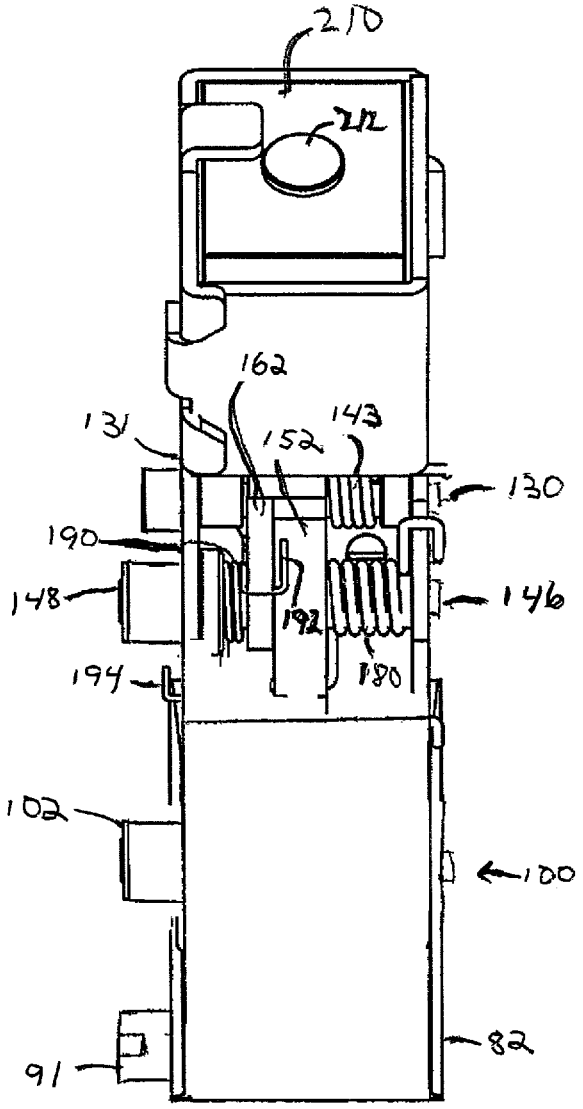
FIG. 20 is a front elevational view showing the latch assembly of FIG. 2 in an unlocked position.
Figure 21:
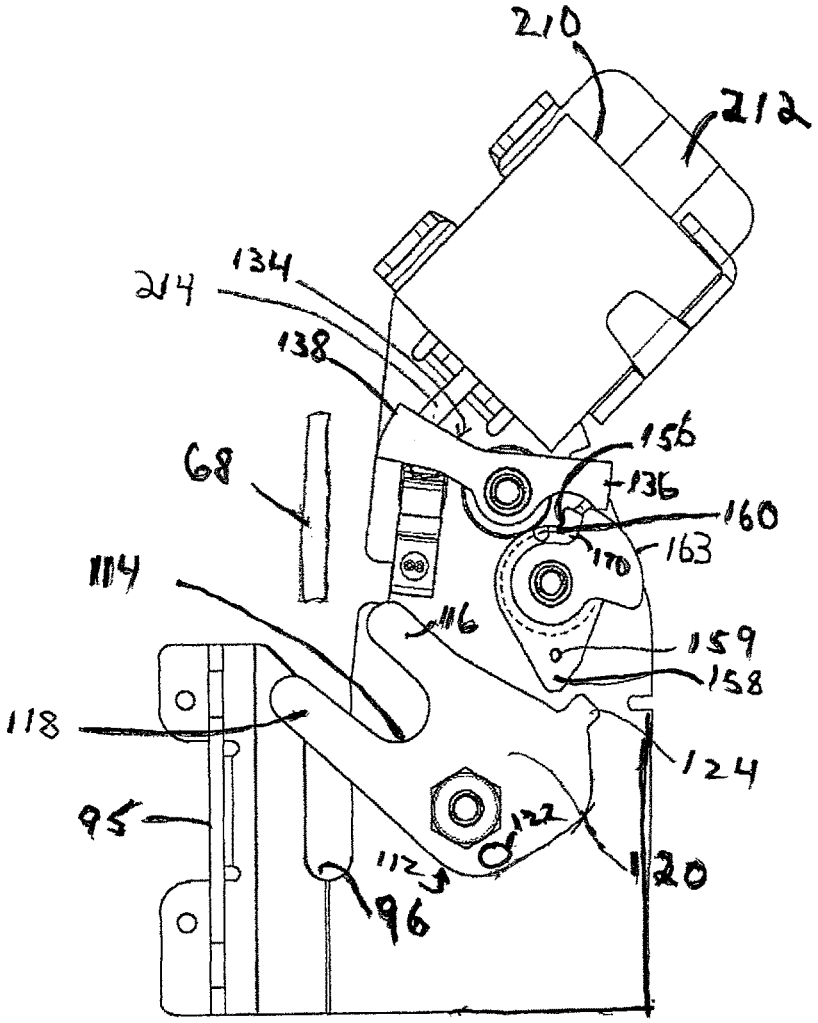
FIG. 21 is a side elevational view showing the latch assembly of FIG. 2 in an unlocked position with a striker member positioned above the slots.
Figure 22:
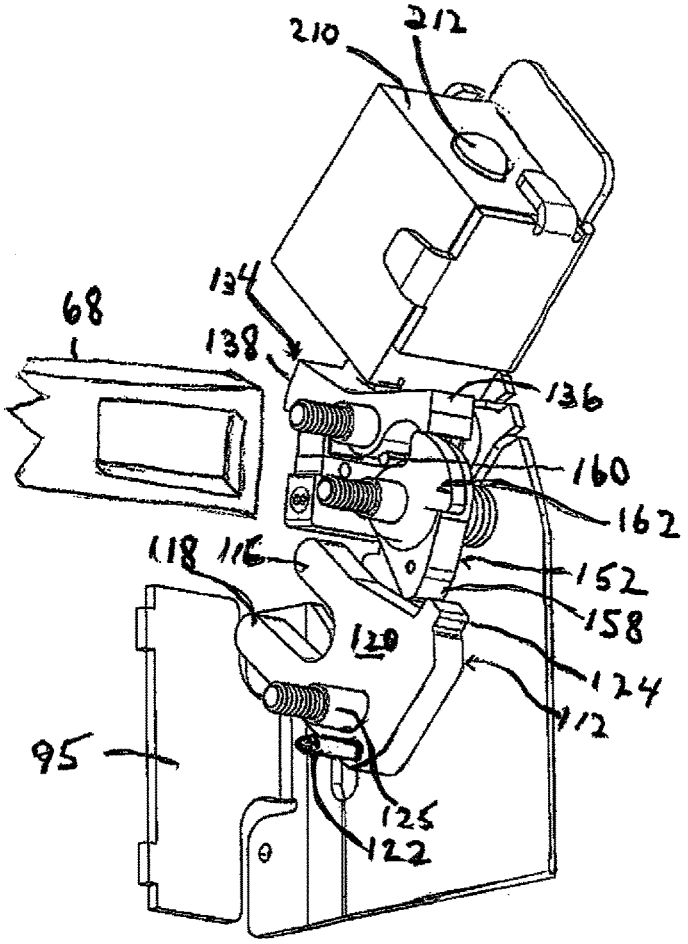
FIG. 22 is a perspective view in partial cutaway showing the latch assembly of FIG. 2 in an unlocked position with a striker member positioned above the slots.

An open-status limit switch 208 may be attached or positioned proximate to the housing 80, generally below the latch 112, as shown in FIG. 18B. The open-status limit switch 208 has a contact arm 209. When the striker plate 68 slides down to engage the latch 112, causing the latch 112 to rotate into a "closed" state, the post 122 rotates away from the contact arm 209, which causes the electrical circuit to open, which provides an indication that the door is in a "closed" state. When the latch 112 rotates in the opposite direction toward an "open" state, the post 122 rotates toward contact arm 209, causing closure of the circuit and returning the circuit to a closed status, thus indicating the door as being in an "open" state.

A solenoid 210 may be mounted to or otherwise associated with the housing 80. The solenoid 210 may include a housing 211 and has a push button 212 and a piston 214. The solenoid 210 includes an actuator that receives an electronic actuation signal from the control assembly 300.

Figure 9A:
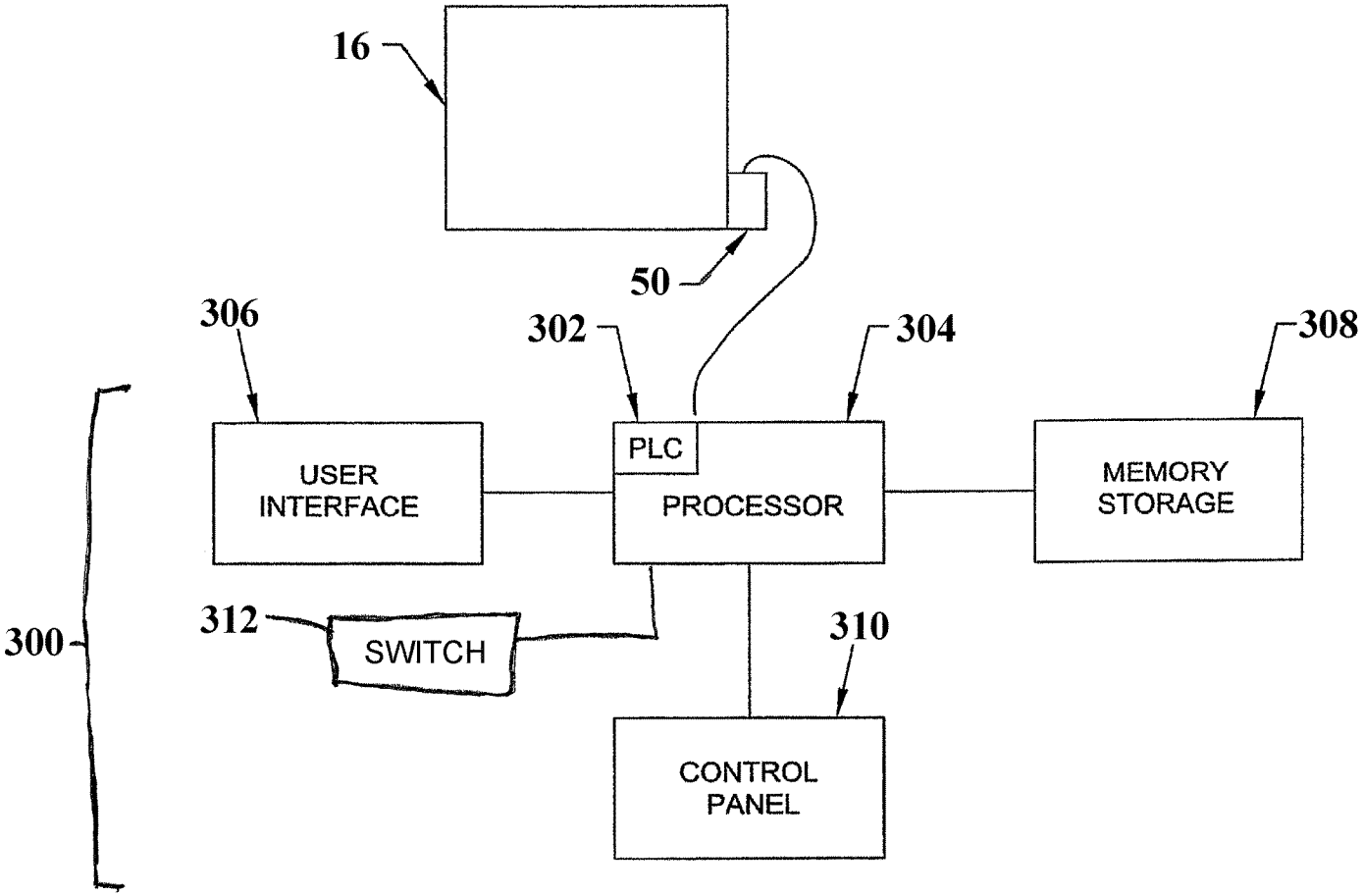
FIG. 9A is a schematic view of one exemplary embodiment of a control assembly.

In exemplary embodiments, the locking apparatus 50 further includes a control assembly 300, as shown in FIG. 9A, which has a programmable logic controller ("PLC") 302, as part of a processor 304 and logic board, which is in electronic communication with the limit switch 200. The control assembly 300 may include an user interface 306 (such as, but not limited to, a keypad, key/lock, magnetic or optical card reader, bar code reader, keypad, radio frequency identification tag, fingerprint, eye or other biometric scanner, voice recognition device, combinations of the foregoing and the like), and a facility manager accessible control interface. The control assembly 300 may also include memory storage 308 for storing and retrieving user access identification information and for managing access and generating reports. A facility manager or other authorized user may access the processor 304 via a control panel 310. The control assembly 300 may also include a relay 332 and a status monitor 334. FIG. 9C is a schematic illustration of one exemplary embodiment of wiring of the solenoid 210, open-status limit switch 208 and locked-status limit switch 200.

The lock-status limit switch 200 is positioned beneath the stop arm 138 portion of the release lever 134. When the piston 214 is extended it contacts the stop arm 138 forcing the release lever 134 to rotate. In this position, the arm 138 depresses the limit switch arm 212, closing an electrical circuit in the lock-status limit switch 200 and causing a signal to be transmitted indicating an unlocked condition of the locking apparatus 50. It is to be understood that a different mechanism can be used instead of a limit switch to detect and/or transmit locked/unlocked condition information.

The lock-status limit switch 200 may also optionally incorporate a first indicator member 320 (not shown) internal to the switch to monitor resistance in the electrical circuit. In exemplary embodiments, the first indicator member 320 may be an internal resistor. In exemplary embodiments, the open-status limit switch 208 may have its own indicator member 330 that is similar to the first indicator member 320. In exemplary embodiments, both switches 200, 208 include an indicator member. In alternative embodiments, only one of the switches 200, 208 includes an indicator member. In exemplary embodiments, the control assembly 300 constantly or periodically monitors the resistance across the resistors. If a wire in the circuit is cut (e.g., intentionally, or for example, by being gnawed through by an animal), resistance drops to zero, which can cause the control assembly to trigger an indicator to a system user that there is a problem with the system. This feature permits remote monitoring of the lock and electrical system integrity.

The ability to monitor the door's open/close status is a desirable feature because it provides the ability to monitor the security of the door, as well as to enable the control assembly to collect and monitor the frequency and timing with which the storage unit associated with that door is accessed. The feature of the open-status limit switch provides the advantage that a system user can diagnose or troubleshoot problems, e.g., misfires of the solenoid and whether the lock is actually in an unlocked state. For example, the control assembly can be configured so that the solenoid 210 fires (i.e., is actuated to cause the piston to move, and in turn cause the pin head 215 to extend), and then the control assembly checks to see if an unlocked state is achieved (by monitoring the open or closed state of the open-status limit switch 200 and contact arm 202). If, after the solenoid 210 is actuated several times and no change in state is detected, the unit can be signaled to be deactivated and an alert sent to the system monitor that there is a problem with the unit.

In exemplary embodiments, a locking apparatus 50 generally comprises the main components of a striker member 52, a release lever 134, a cam 152, a trigger 162, a latch 112, a solenoid 210. The locking apparatus 50 may also include a limit switch 200. The release lever 134, cam 152, trigger 162 and latch 112 each have a torsional spring associated therewith (springs 143, 180, 190 and 126, respectively) which bias rotational movement of each of these four components in one direction. When the latch assembly 54 is in a locked position (as shown in FIGS. 10-13 (perspective views) and FIGS. 14-16 (partial cutaway views)) the striker plate 68 is held in the slot 96 and removal is prevented. The position of activation is the locked position where the solenoid piston 214 is in the retracted position (i.e., extending relatively less outside of the solenoid housing 211 than in the extended position). The cam 152 is held in place by the release lever 134 release arm 136 contacting the tooth 156. The trigger 162 is also maintained in place by the release lever arm 136 by means of the detent 170 portion of the trigger body 168. The latch 112 is maintained in the locked position (i.e., engaging the striker plate 68) by the nose portion 158 of the cam 152.

In exemplary embodiments, the latch assembly 54 can be mounted to one of the vertical guide tracks 12 or 14, or proximate thereto (see FIG. 2). FIGS. 17-22 show views of one exemplary embodiment of a latch assembly 54 in an unlocked position. In the unlocked position, the striker plate 68 (shown only in selected views to avoid obstructing viewing of other parts) is positioned above the latch assembly 54 as the door 16 is lowered. In the unlocked position, the solenoid piston 214 is in an extended position (see FIGS. 18A and 18B). The trigger latch second leg 118 is shown angled upward as biased by the first spring 126 so that the U-shaped opening 114 is angled upward and so that the striker plate 68 can enter the opening 99, the opening 114 and the slots 96. Overall, in exemplary embodiments, in the unlocked position the release lever 134 does not engage the cam 152 (see FIGS. 21, 25 and 26). The release lever arm 136 rests on the trigger 162 curved edge 163 (see FIG. 21) until the latch 112 rotation (locking) forces rotation of the cam 152.

To lock the striker plate 68 in the latch assembly 54, the rollup door 16 is lowered and the striker plate 68 slides into the slots 96, as shown in FIGS. 10-16. The bottom edge 72 of the striker plate 68 contacts the second leg 118 of the latch 112, causing the latch 112 to rotate against the spring 126 bias so that the first leg 116 prevents the striker plate 68 from traveling up and out of the slots 96 (see FIG. 16). As the latch 112 rotates (counterclockwise as viewed in FIGS. 14 and 21), the tab 124 contacts the nose 158 of the cam 152, forcing clockwise rotation of the cam 152 against the spring 180 bias and holding the latch 112 in a locked position with the nose portion 158. As shown in FIGS. 22-31, clockwise cam 152 rotation causes the cam post 160 to contact the trigger 162 at the detent 170, forcing clockwise rotation of the trigger 162 against the torsion spring (180)-biased rotation, thus allowing the release arm 136 to release, rotate counterclockwise and snap into place behind the tooth 156 of the cam 152. In this locked position the release lever stop arm 138 does not contact the limit switch contact arm 202. This consequently forces the piston 214 at least partially back into the solenoid 210 and results in locking of the latch assembly 54. The latch assembly 54 acts to maintain the striker plate 68 in a locked position such that the striker plate 68 is vertically restricted in the opening 114 and horizontally restricted in the slots 96.

Figure 23:
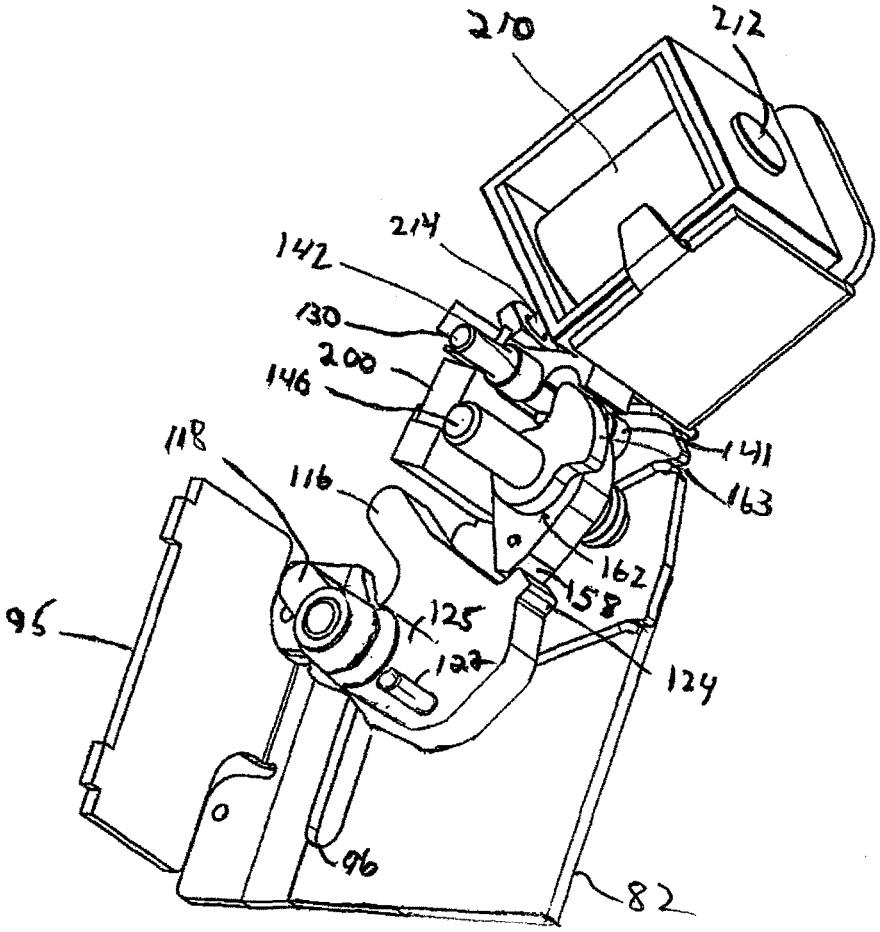
FIG. 23 is another perspective view in partial cutaway showing the latch assembly of FIG. 2 in an unlocked position and the release arm engaged with the trigger.
Figure 24:
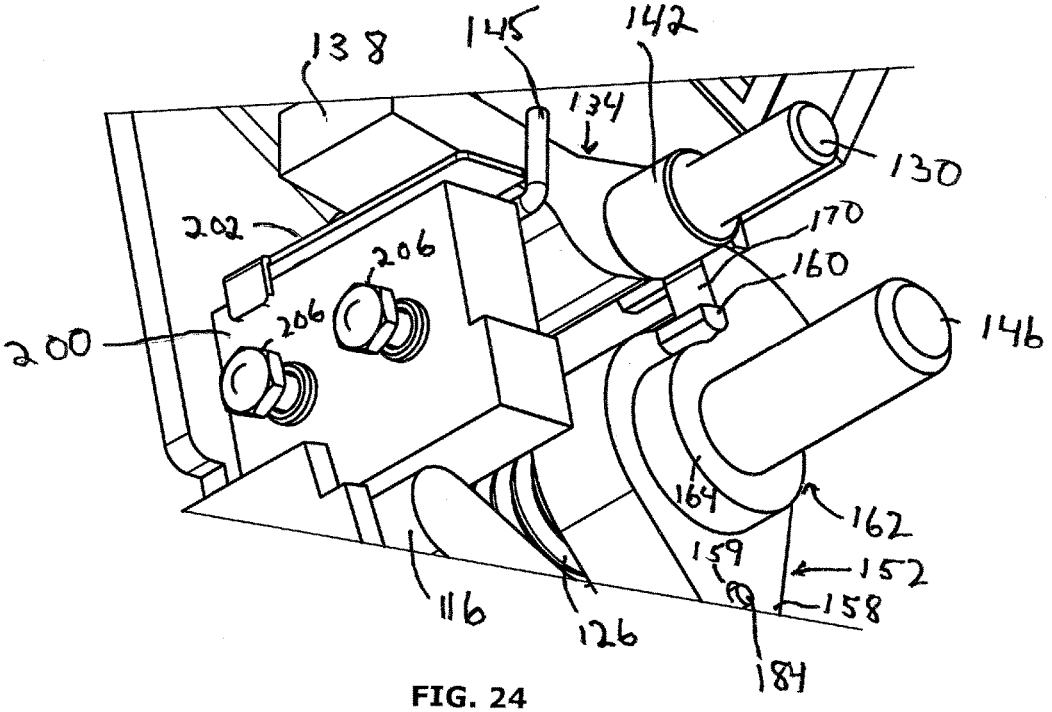
FIG. 24 is a schematic view of a detail of the limit switch, release lever, cam and trigger showing the release lever engaged with the trigger and the cam post engaged with the trigger detent.
Figure 25:
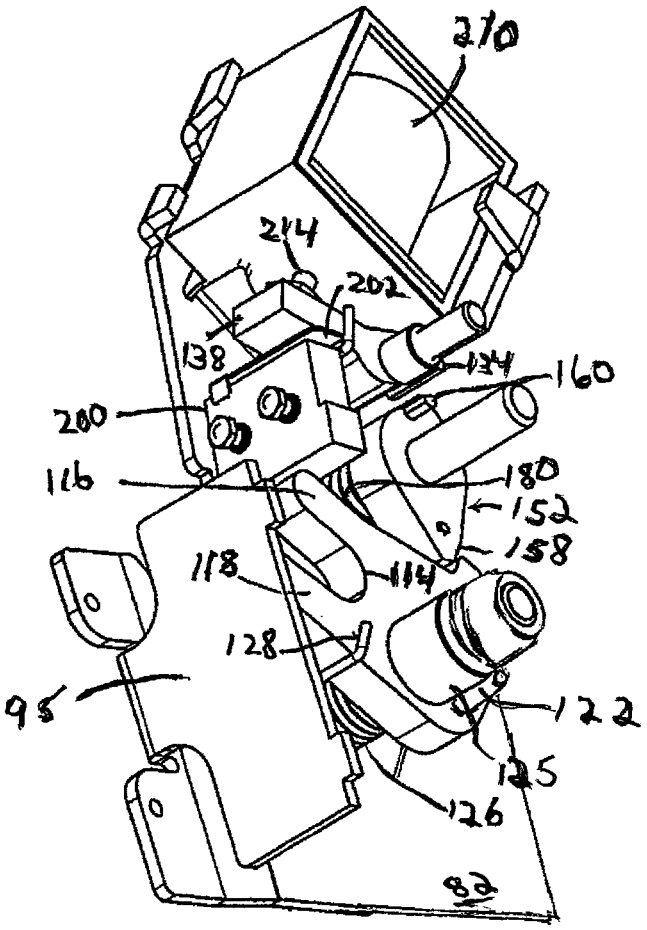
FIG. 25 is a right-front perspective view in partial cutaway showing the latch assembly of FIG. 2 in an unlocked position showing the release lever disengaged from the cam tooth and the release lever contacting the limit switch contact arm.
Figure 26:
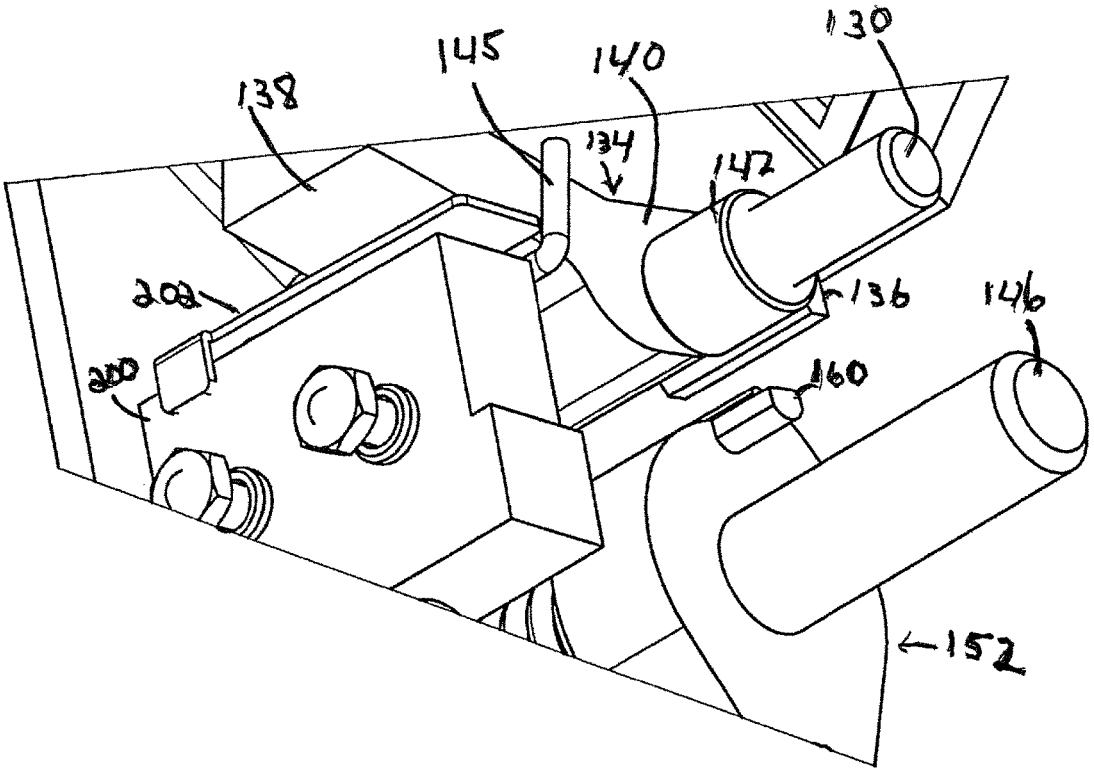
FIG. 26 is a schematic view of a detail of the limit switch, release lever and cam showing the release lever disengaged from the cam tooth.
Figure 27:
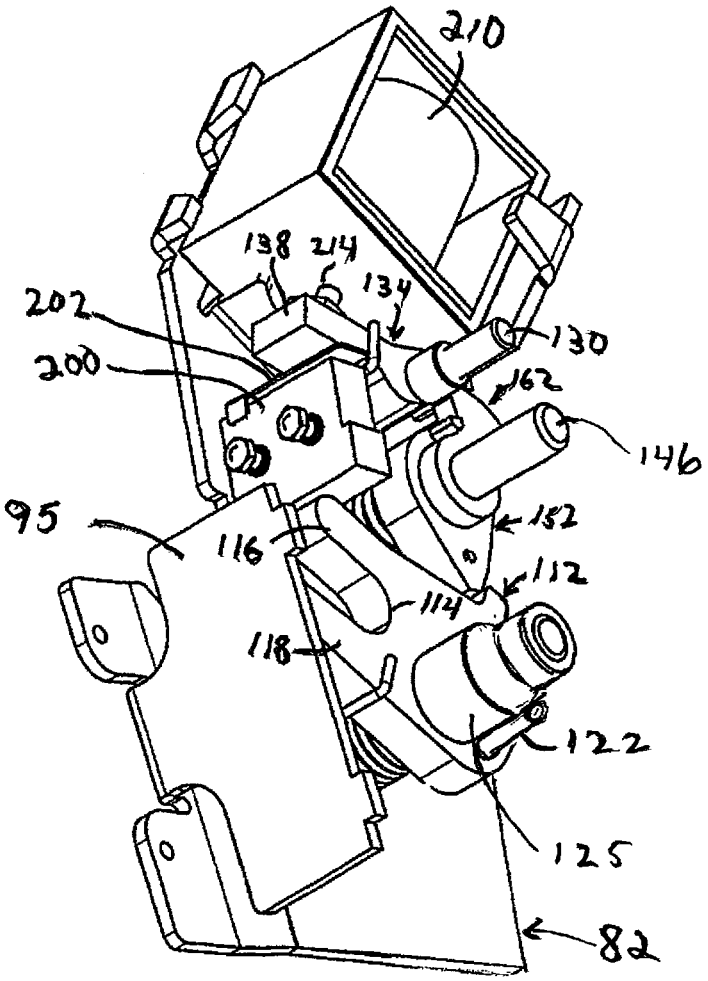
FIG. 27 is a right-front perspective view in partial cutaway showing the latch assembly of FIG. 2 in an unlocked position showing the release lever disengaged from the cam tooth.
Figure 28:
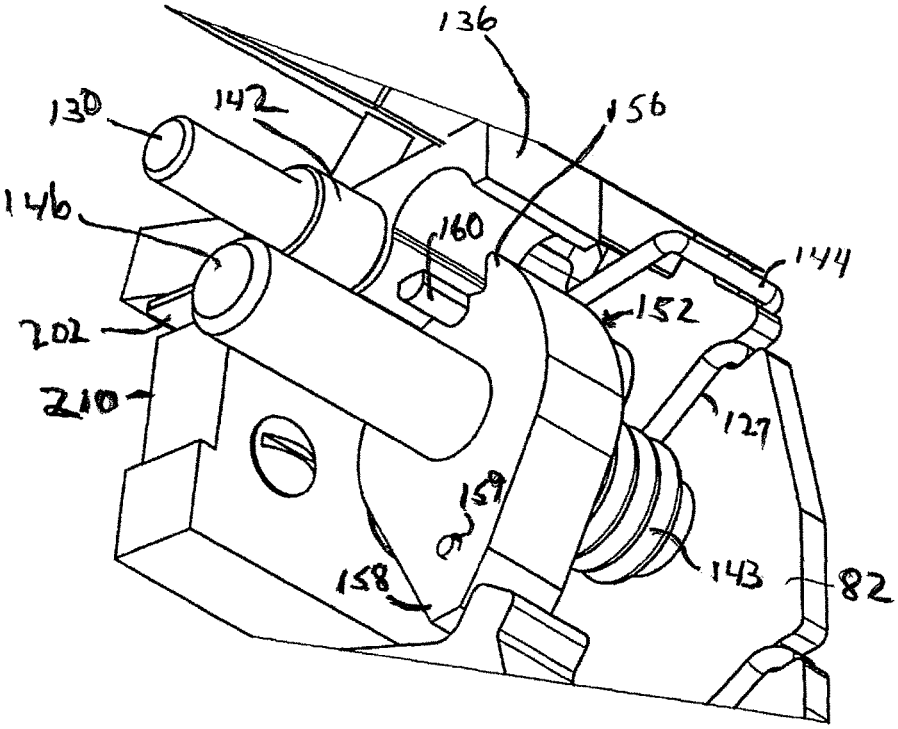
FIG. 28 is a schematic view of a detail of the release lever and cam showing the cam and latch tab.
Figure 29:
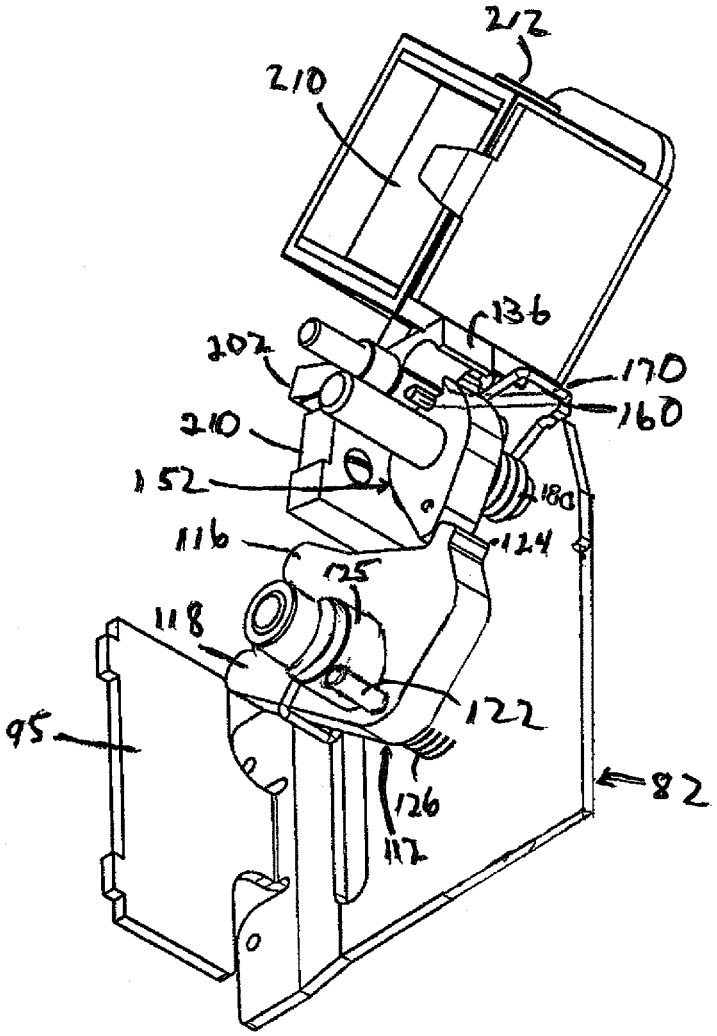
FIG. 29 is a left-front perspective view in partial cutaway showing the latch assembly of FIG. 2 in an unlocked position showing the release lever disengaged from the cam tooth.
Figure 30:
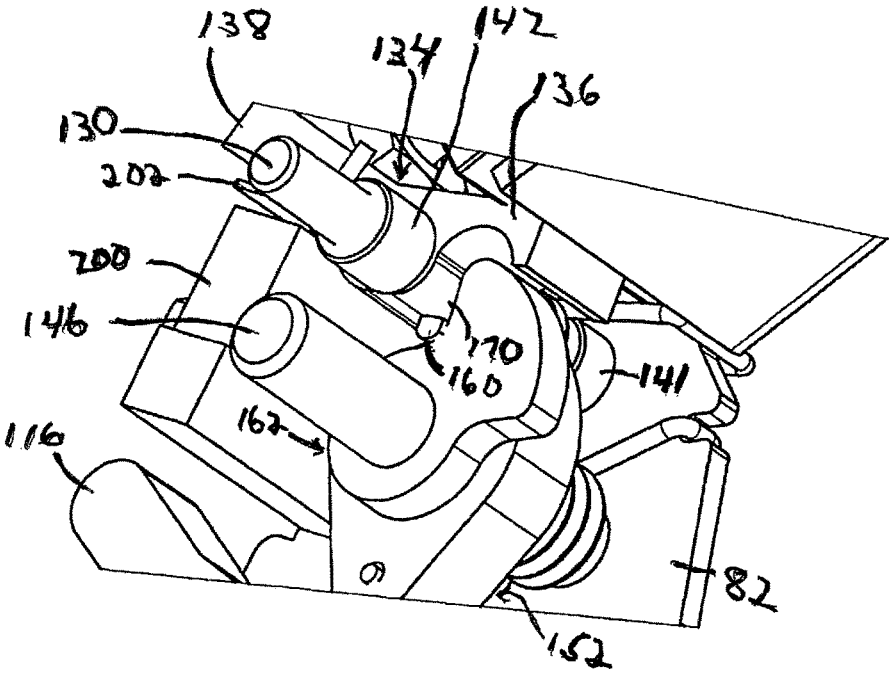
FIG. 30 is a schematic view of a detail of the release lever and cam showing the trigger and cam.
Figure 31:
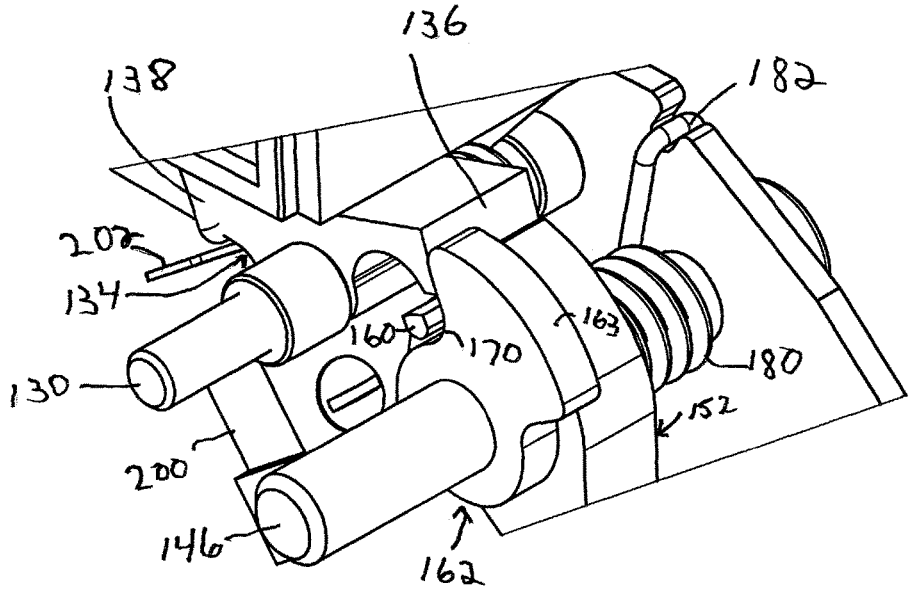
FIG. 31 is another schematic view of a detail of the release lever and cam showing the trigger and cam.

To unlock the latch assembly 54 from the locked position and release the striker plate 68, the solenoid 210 is activated manually (by depressing the button 212) or electronically, causing the piston 214 to extend. The extension of the piston 214 causes release lever 134 to rotate about the pin 130 against the torsion spring (143)-biased rotation force, causing the stop arm 138 to pivot downward and the release arm 136 to pivot upward (as shown in FIGS. 23-24). The release arm 136 then disengages from the cam tooth 156. The cam 152 rotates and the nose portion 158 disengages from the latch 112 tab 124. The latch 112 rotates to permit the striker plate 68 to slide out of the slot 96 and the door 16 to be raised. FIG. 26 illustrates the cam 152 and post 160 (with the trigger 162 not shown). In this position, the cam 152 does not contact the release lever 134. The release lever 134 is maintained in this position by the trigger 162 (not shown in FIG. 26). The limit switch 200 can detect the movement of the latch 112. The stop arm 138 contacts the limit switch contact arm 202 which opens or closes electrical circuit and prompts the control assembly 300 to indicate that the door 16 is locked or unlocked in the locking apparatus 50.

Figure 9B:
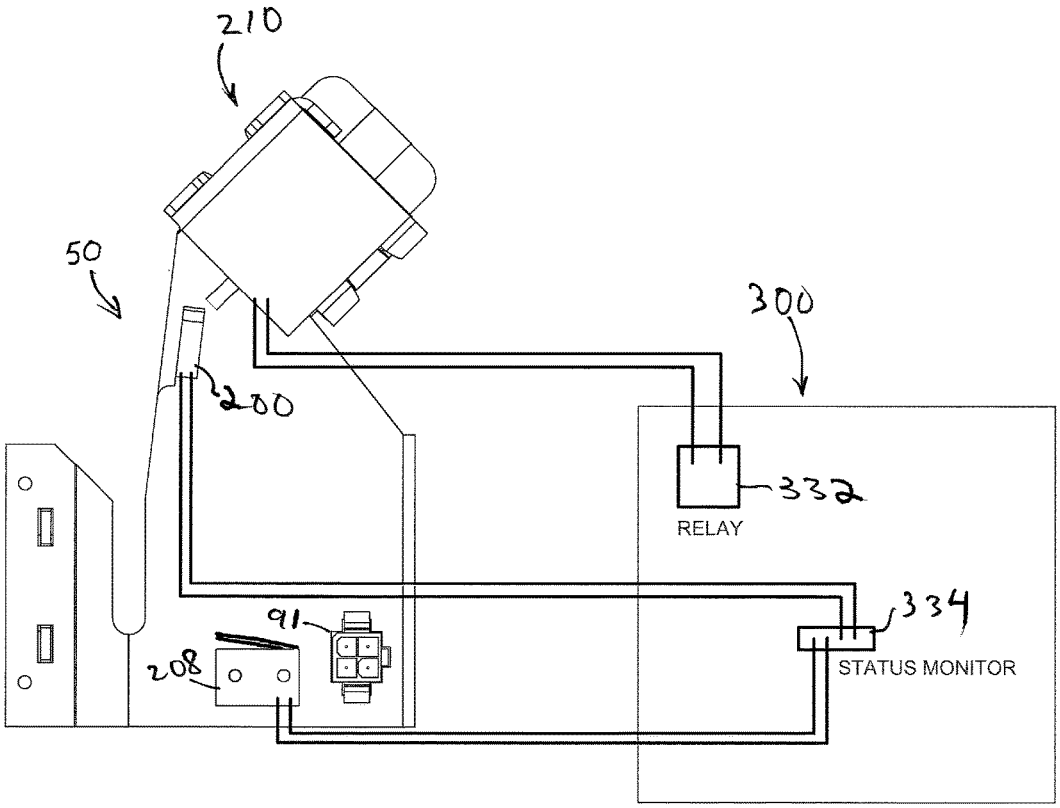
FIG. 9B is a schematic flow diagram showing electrical current flow according to one exemplary embodiment.
Figure 9C:
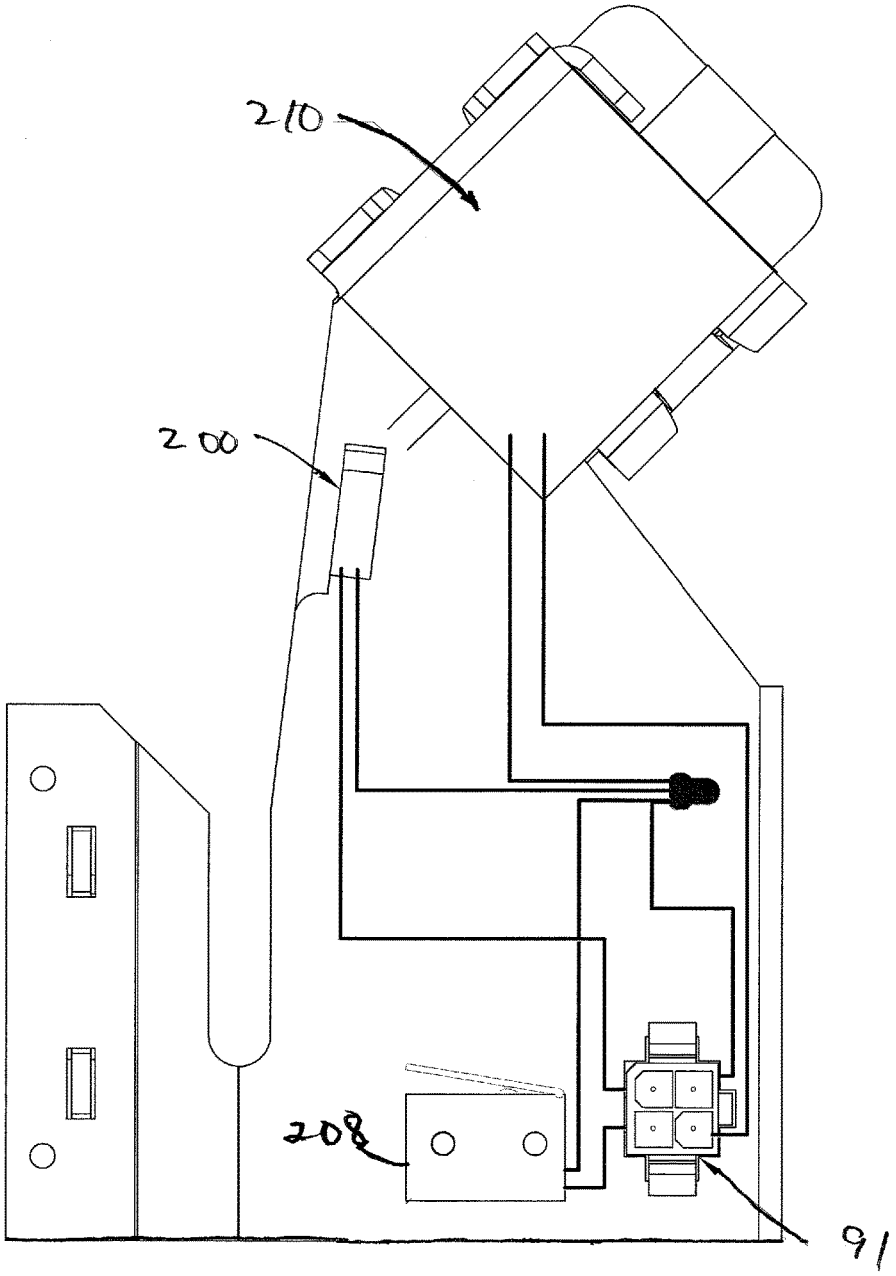
FIG. 9C is a schematic flow diagram showing wiring of the solenoid, open-status limit switch and locked-status limit switch, according to one exemplary embodiment.
Figure 10:
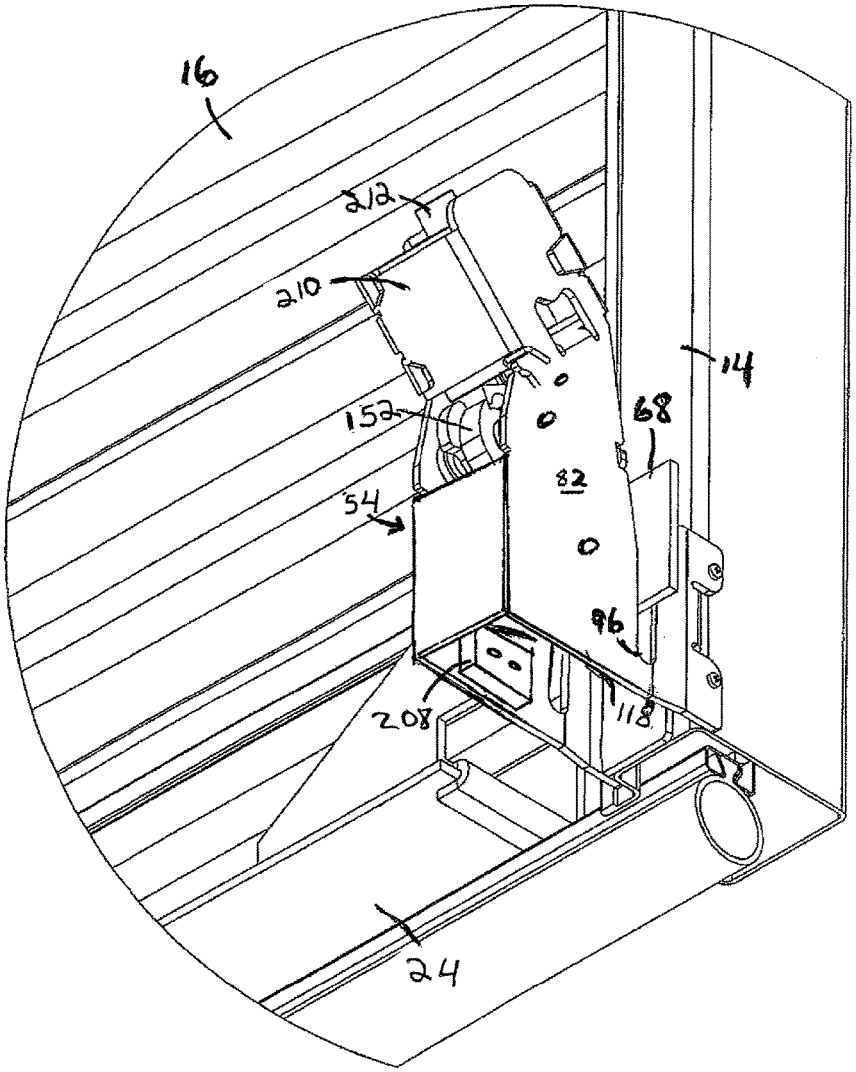
FIG. 10 is bottom-side perspective view of the locking apparatus of FIG. 2 showing a striker member shown in a locked position with a latch assembly.
Figure 11:
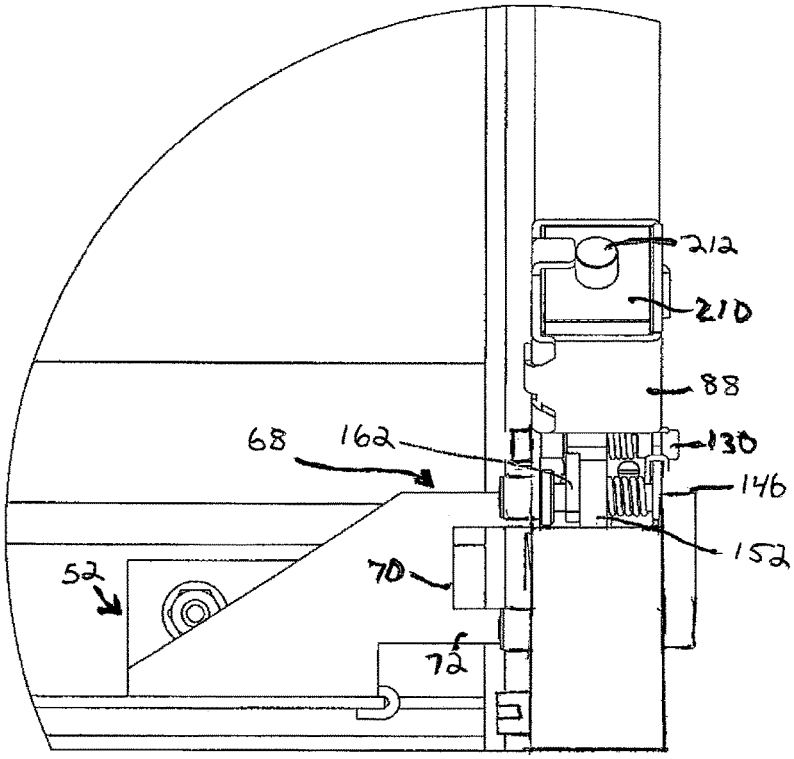
FIG. 11 is front elevational view of the locking apparatus of FIG. 2 showing a striker member shown in a locked position with a latch assembly.
Figure 12:
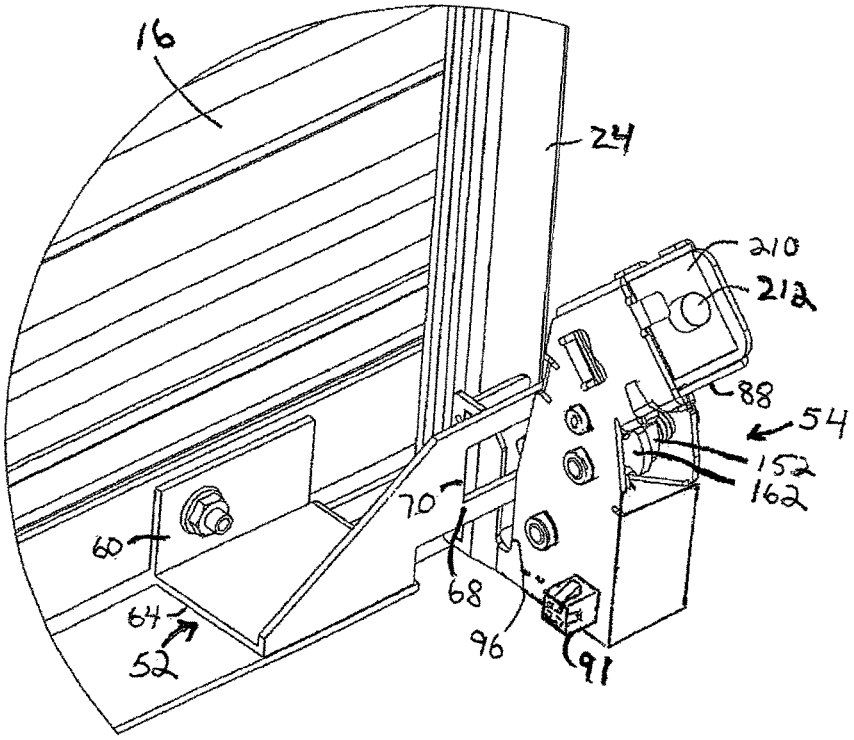
FIG. 12 is a perspective view of the locking apparatus of FIG. 2 showing a striker member shown in a locked position with a latch assembly.
Figure 13:
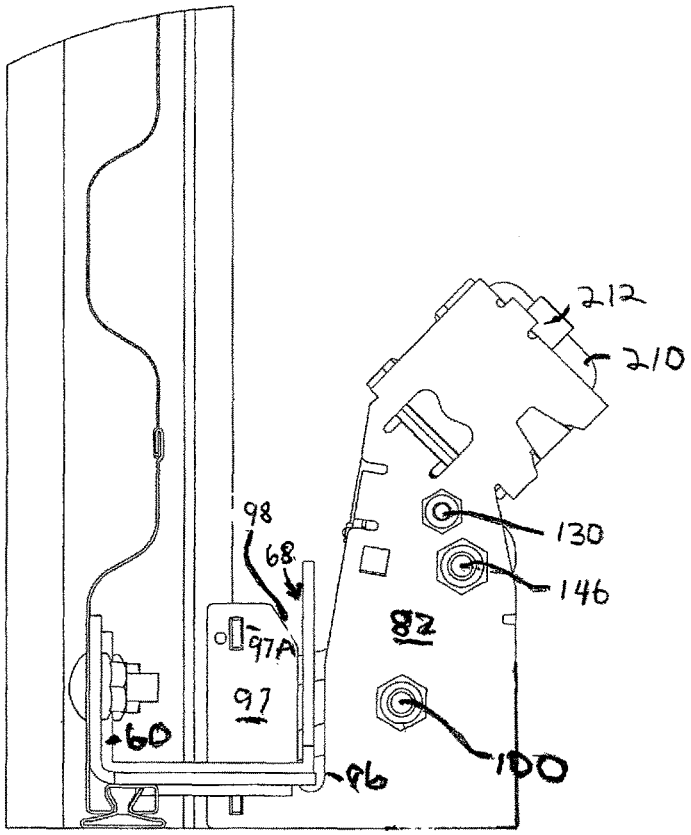
FIG. 13 is a side elevational view of the locking apparatus of FIG. 2 showing a striker member shown in a locked position with a latch assembly.
Figure 14:
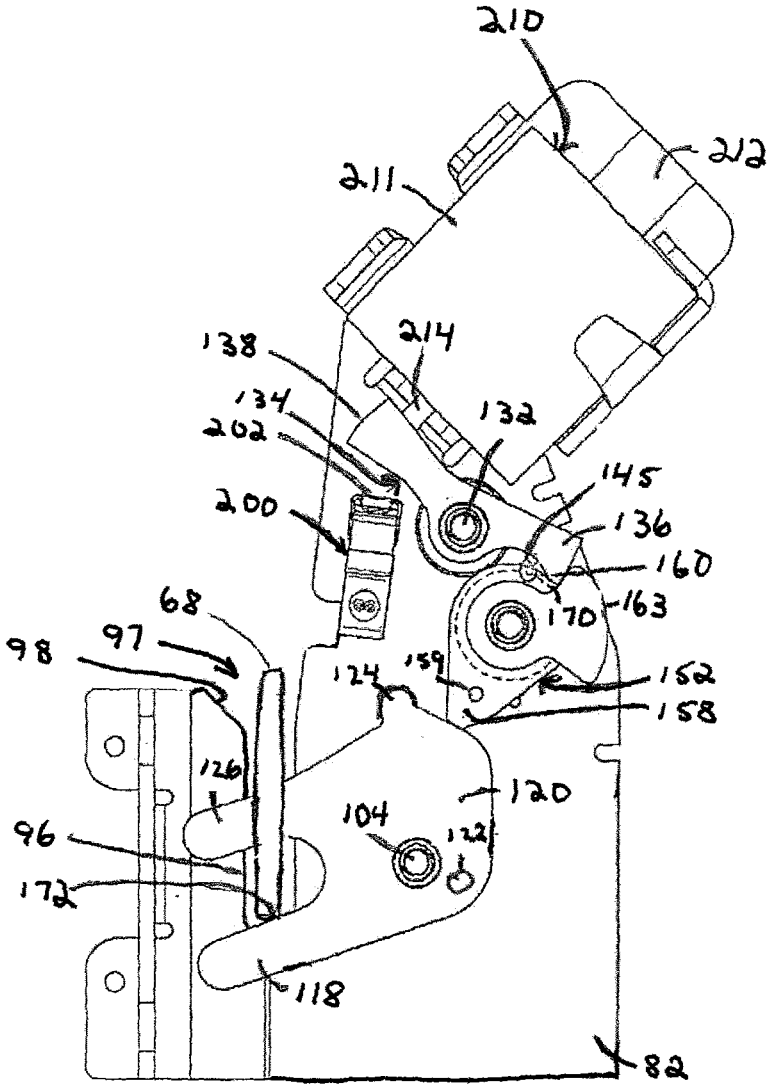
FIG. 14 is a side elevational view in partial cutaway showing the latch assembly of FIG. 2 a locked position.
Figure 15:
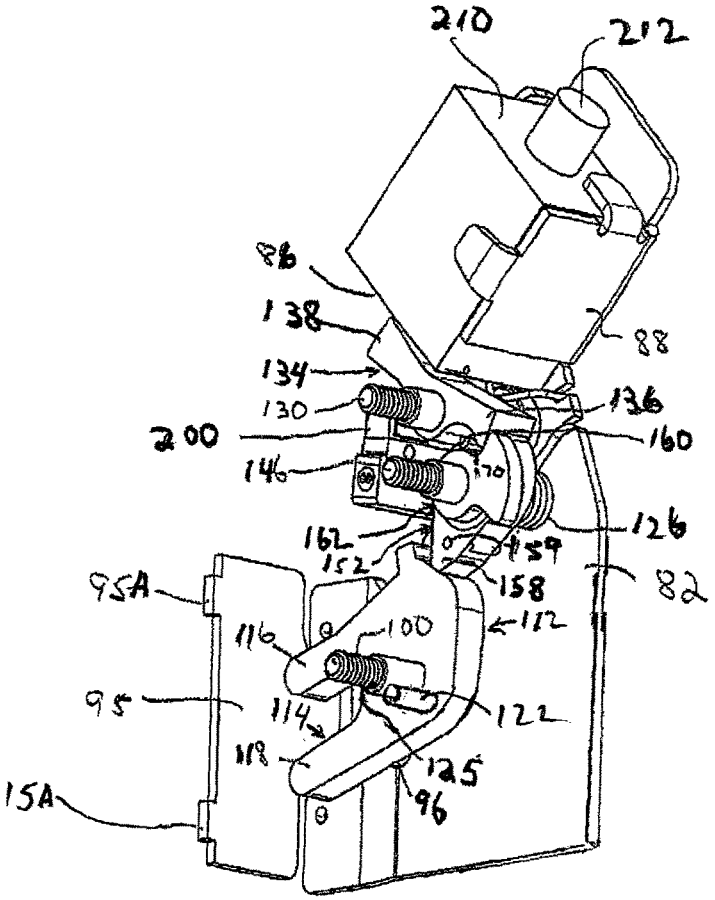
FIG. 15 is a left side perspective view in partial cutaway showing the latch assembly of FIG. 2 a locked position.
Figure 16:
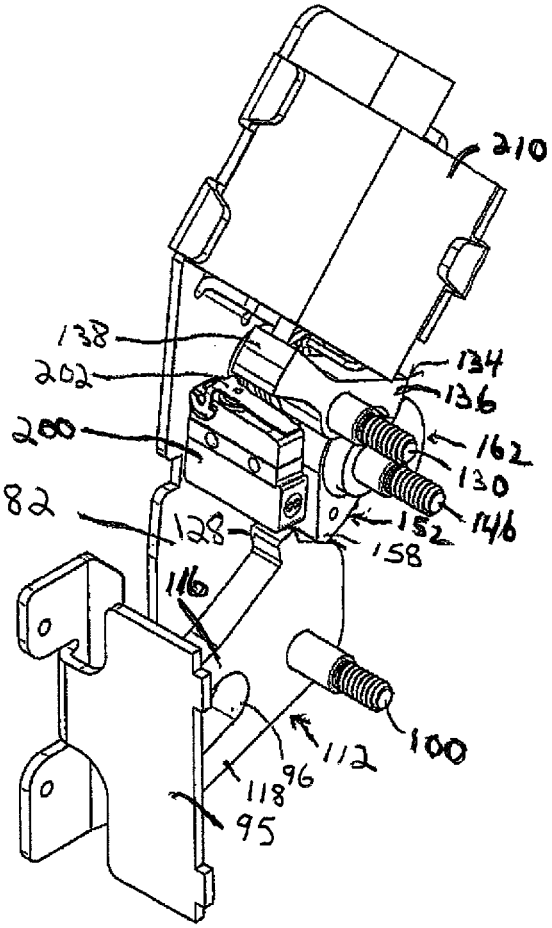
FIG. 16 is a right side perspective view in partial cutaway showing the latch assembly of FIG. 2 a locked position.
Figure 17:
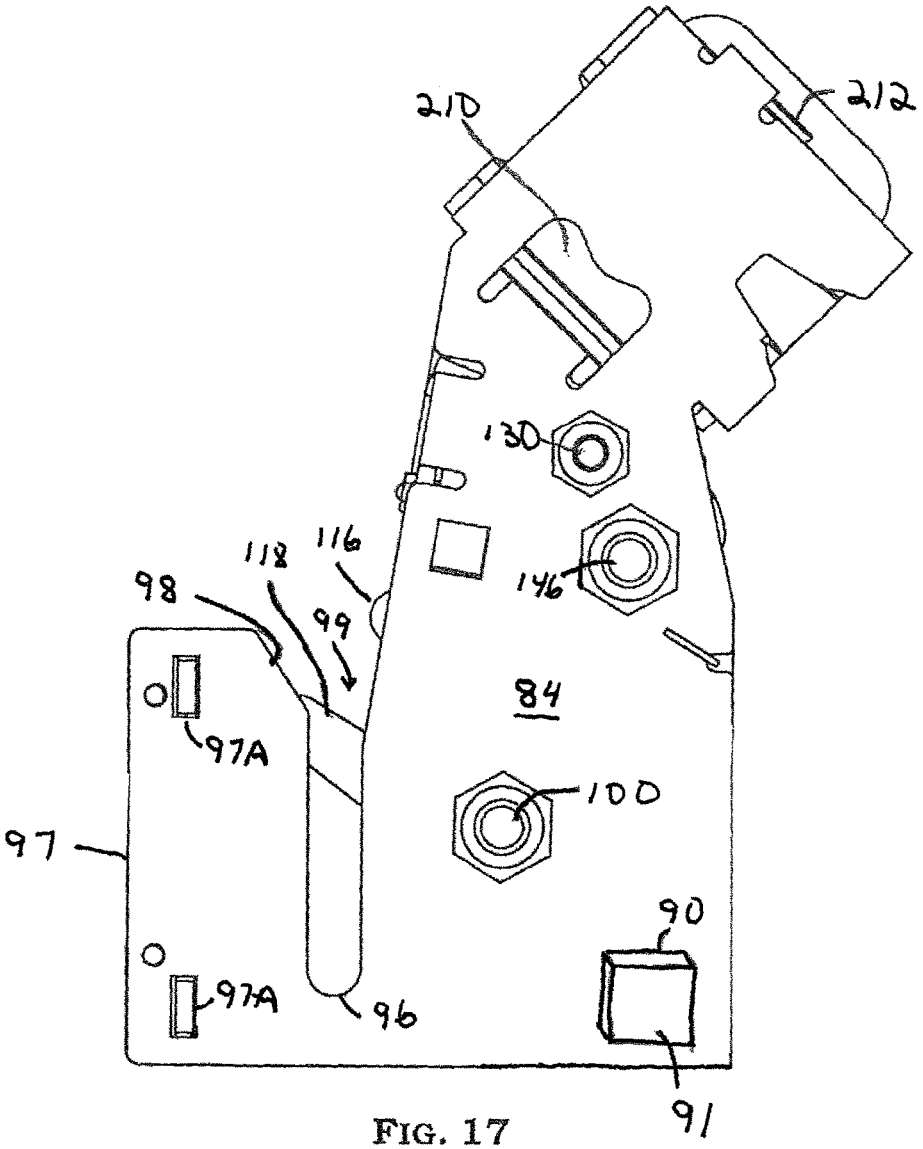
FIG. 17 is a side elevational view showing the latch assembly of FIG. 2 in an unlocked position.

FIG. 9B shows one exemplary embodiment of an electrical communication flow among the major components. The limit switch 200 communicates with the controller 300; the solenoid is activated by an electrical signal (or manually when the button 212 is pressed). When the latch assembly 54 is in a locked state electricity flows from the control panel 310 logic board through the limit switch 200 in a normally closed circuit. The control panel 310 monitors/detects when current is present and the latch assembly 54 is in a locked state. An operator can send a signal through the user interface 306 or an electrical switch 312 to apply voltage (from a power source 314 to the solenoid 210. The current will actuate the solenoid pin 214 to extend, causing the stop arm 136 to rotate and disengage from contact with the contact arm 202. This opens the limit switch 200 circuit, stopping the current flow and also results in the latch assembly 54 being placed into an unlocked state. The control panel 310 detects that the latch assembly 54 is in an unlocked state. When the door 16 is closed and the striker plate 68 engages the latch 112, stop arm 136 contacts the limit switch contact arm 202 and closes the electrical circuit again, and the latch assembly 54 is converted into the locked state, as described hereinabove. It is to be understood that the electrical communication flow can be implemented in a manner in which the circuit is open when the latch assembly 54 is in the locked stated and closed when in the unlocked state.

In one exemplary embodiment, the door 16 further includes a motor for raising and lowering the door 16. The limit switch 200 can be used as or as part of an interlock to electronically communicate (either via the control assembly 300 or directly) with the motor. The limit switch 200 can detect whether the striker plate 68 is engaged with the latch assembly 54 (i.e., the door is locked) and, if so, to not actuate (or to deactuate) the motor, thus avoiding potential overload or burnout of the motor.

An operator of the control assembly 300 can remotely activate the solenoid 210 to unlock the latch assembly 54, or, a user can enter a password on a keypad or other user interface to activate the solenoid 210. If the latch assembly 54 is in the locked position, as indicated by the lock-status limit switch 200 being closed, the operator can cause the control assembly 300 to send an electronic signal to actuate the solenoid 210 and cause the piston 214 to extend, thereby causing stop arm 136 to disengage from the trigger detent 170 and the trigger 162 to pivot counterclockwise. The trigger spring 190 and the cam spring 180 urge the trigger 162 and the cam 152, respectively, to rotate. The first spring 126 causes the latch 112 to rotate, thereby allowing the striker plate 68 to travel upward away from the latch assembly 54 and allowing the door 16 to be raised. The release lever 134 rotates and the stop arm 138 moves so that it no longer contacts the contact arm 202 of the lock-status limit switch 200, resulting in the electrical circuit being opened and providing an indication that the unit is in the locked state. When the door is at least partially open, the striker plate 68 is not engaged with the locking apparatus 50 and the door 16 is in the furthest "downward" or closed position. The open-status limit switch 208 provides an indication whether the door 16 is in an open or closed position. The door 16 is in a closed position when the striker member 68 is engaged and locked by the latch 112 (in which state the post 122 does not contact the open-status limit switch contact arm 209 and the circuit is open).

The latch assembly 54 can be manually unlocked from a locked position. A user manually presses the solenoid button 212, causing the piston 214 to extend, which causes the latch assembly 54 unlock, as described hereinabove. Manual unlocking can be an important feature where the door is accidentally lowered and locked and someone is inadvertently locked inside a storage unit (where there may be no accessible user interface) or if there is a power outage that disables the control assembly 300 and the solenoid 300 from operating.

Another exemplary embodiment of the present disclosure provides an electronically controlled rollup door system. The system includes a rollup door adapted to move within a pair of opposing guide tracks, at least one striker member as described herein, at least one latch assembly as described herein, and a control assembly as described herein.

In another exemplary embodiment, a method is provided for controlling and managing access to a door from a remote location. A locking apparatus 50 is mounted to a rollup door 16 as described hereinabove. When a storage unit tenant (for example) desires access to the storage unit, the tenant enters his or her access identification information using any of several possible user interfaces 306. The identification information entered by the tenant is compared to a value stored in memory storage 308 (or other location). If the tenant's identification information is validated (e.g., if the tenant is authorized and there is no balance due on the tenant's account), the processor 304 sends a signal to the solenoid 210, which extends the piston 214, causing the latch assembly 54 to unlock the striker plate 68 and allowing the door 16 to be raised. When the tenant recloses and locks the door 16, the striker plate 68 reengages the trigger latch 112 and slots 96 and is locked in place.

The present disclosure also provides in exemplary embodiments a lockable system comprising a movable door or other object, a fixed member (such as a door frame, door jamb, window sill or the like), and a locking apparatus comprising a striker member as described herein according to various exemplary embodiments and at least one latch assembly as described herein according to various exemplary embodiments.

In exemplary embodiments, a locking apparatus and control system as described hereinabove, a user interface may include a display that can indicate to a tenant that rent is overdue and to see the facility manager. Such apparatus and control system may be used to prevent a tenant who is behind on rent from unlocking the door to his or her unit until the past due balance is paid. Accordingly, in exemplary embodiments, a method for managing access to a facility, such as, but not limited to, a storage unit, comprises providing a locking apparatus as described hereinabove. The apparatus includes a control assembly 300 that has user account information stored in memory storage 308. Alternatively, such information may be stored remotely (for example, in the cloud or hosted at a remote server) and accessed over the internet. A user interface queries the user to enter login credentials (for example, user name, password, storage unit number, account number, or other information). Alternatively, a card entry system can be used whereby a card reader is provided that adapted to read a card having the user/tenant's information stored in the card. The card reader is in communication with the control assembly 300 or a remote control center. The card reader can be placed at the entrance gate of, for example, a self-storage facility. Upon detecting a valid card, the card reader may signal the control assembly 300, which in turn can transmit a signal to cause the gate to open. Further, the control assembly can send a signal to a locking apparatus according to one or more exemplary embodiments of the present disclosure so that the locking apparatus unlocks the door and permits a user to raise the door (or cause a motor to be actuated, which will cause the door to be raised). In exemplary embodiments, a software application stored on a mobile device can hold and transmit the user's login credentials, such as by Bluetooth or the like. In exemplary embodiments, a biometric scanner or reader may be used, such as, but not limited to, a fingerprint, retinal, face, or voice reader or scanner. Alternatively, a key and lock may be used.

Upon entry of such login credentials the control assembly validates the credentials against existing stored information for that set of login credentials. If the user is validated, the control assembly may signal the user interface to display a message, for example, "Access Granted" or other message. The control assembly may signal the solenoid 210, which, as described hereinabove, causes the striker plate to be disengageable from the latch assembly 54, thereby permitting the user to open the door 16. If, on the other hand, the login credentials are invalid, the control assembly 300 may signal a message to display on the user interface indicating invalid credentials (and, e.g., to try again). Alternatively, if the credentials are validated, the control assembly may access the user's account information and, if the account is current (and if there is no other reason to deny access), the door is unlocked. However, if the account shows a balance due, the control assembly may signal the user interface to display a message, e.g., "Account Overdue, Please See Facility Manager for Access," or the like, and prevent the door from unlocking. In exemplary embodiments, the user interface may include a microphone and speaker and the user can actuate the microphone to speak to the facility manager for help. In exemplary embodiments, the user interface may include video communications apparatus for permitting visual and audio communication between the user and a remote facility manager. In exemplary embodiments, the control assembly may be in communication with a remote central station that itself is connected to many facilities, thus enabling a facility manager to be in a remote location and manage access to a large number of units.

A facility manager can monitor access to a number of storage units and determine which units have been accessed and when. The processor can log when the door was opened and reclosed and a report can be generated from the data.

In another exemplary embodiment, the locking apparatus of the present disclosure can be adapted to provide wireless remote access control. Such an apparatus can use the locking apparatus as described hereinabove, but also include a wireless transceiver associated with the solenoid (and may also be associated with the limit switch, if included).

In exemplary embodiments, rather than a door 16 being used, the locking apparatus of the present disclosure can be used or adapted for use with other structures to control access. In exemplary embodiments, the striker may be associated with a movable object and the latch assembly may be associated with a fixed object. For example, the locking apparatus 50 may be used to control access to a window drawer, curtain, partition, or the like. Other structures may include, but are not limited to, sliding doors (double or single), sectional doors, swinging doors, locker systems, and the like. The locking apparatus of the present disclosure can be used with door or other systems that are side or horizontal opening (rather than vertical opening, such as a rollup door system). In exemplary embodiments, the locking apparatus as disclosed herein can be used in many applications and structures that include a fixed structure (for example, a door or window frame, wall, jamb, sill or the like) to which a latch assembly can be mounted and a movable component (such as, but not limited to, a door, window, curtain, or the like) that needs to be secured, with which a striker member can be associated.

In one exemplary embodiment a door and locking system are provided comprising a movable door, such as, but not limited to, a rollup door, and a frame associated with the door within which the door can move. A striker member as described herein is associated with the door. In one exemplary embodiment, the striker member is attached to a lower portion of the door that would ordinarily be positioned proximate to the ground when the door is in a closed position. The system further includes a latch assembly according to exemplary embodiments described herein. The system further includes a control assembly as described herein.

In an alternative exemplary embodiment of a door and locking system, rather than a rollup door, a swinging or pivoting door is provided, whereby the striker member is associated with a portion of the door, such as, but not limited, proximate to an edge of the door. As the door, initially in the open position, is closed, the striker member engages the latch assembly, as described herein.

Although only a number of exemplary embodiments have been described in detail above, those skilled in the art will readily appreciate that many modifications are possible in the exemplary embodiments without materially departing from the novel teachings and advantages. Accordingly, all such modifications are intended to be included within the scope of this disclosure as defined in the following claims.

While the methods, equipment and systems have been described in connection with specific embodiments, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

As used in the specification and the appended claims, the singular forms "a," "an" and "the" include plural referents unless the context clearly dictates otherwise. "Optional" or "optionally" means that the subsequently described event or circumstance may or may not occur, and that the description includes instances where said event or circumstance occurs and instances where it does not. Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following inventive concepts.

Any patents, applications and publications referred to herein are incorporated by reference in their entirety.

Claimed is:

1. A locking apparatus for releasably maintaining a striker member in a locked or unlocked position, comprising:

a. a housing including
   - i. a connector member associated with the housing and to which can be connected at least one wiring harness;
   - ii. at least one opening in the housing adapted to removably receive the striker member;

b. a latch assembly associated with the housing and comprising
   - i. a latch rotatably mounted on a first pin, the latch having a first face and an opposing second face, the latch adapted to releasably engage the striker member,
   - ii. a post associated with the first face of the latch,
   - iii. a release lever rotatably mounted on a second pin, the release lever having a release arm portion and a stop arm portion,
   - iv. a trigger,
   - v. a cam,
   - vi. a solenoid adapted to contact the release lever release arm;

c. a first limit switch for detecting an open or closed state of the latch assembly and adapted to be selectively contacted by the release lever stop arm portion, the first limit switch being adapted to be contacted by the release lever stop arm portion;

d. a second limit switch for detecting a locked or unlocked state of the locking apparatus, and adapted to be selectively contacted by the latch post; and, e. a control assembly comprising a programmable logic controller, processor, memory storage and a user interface and in electronic communication with the solenoid, the first limit switch and the second limit switch.

2. The locking apparatus of claim 1, wherein the first limit switch further includes a first resistor in electronic communication with the control assembly.

3. The locking apparatus of claim 1, wherein the second limit switch further includes a second resistor in electronic communication with the control assembly.

4. A locking apparatus and movable door system for releasably maintaining a striker member in a locked or unlocked position, comprising:

a. a movable door;

b. a striker member associated with the movable door;

c. a housing including i. a connector member associated with the housing and to which can be connected at least one wiring harness;

ii. at least one opening in the housing adapted to removably receive the striker member;

d. a latch assembly associated with the housing and comprising i. a latch rotatably mounted on a first pin, the latch having a first face and an opposing second face, the latch adapted to releasably engage the striker member, ii. a post associated with the first face of the latch, iii. a release lever rotatably mounted on a second pin, the release lever having a release arm portion and a stop arm portion, iv. a trigger, v. a cam, vi. a solenoid adapted to contact the release lever release arm;

e. an open-status limit switch for detecting an open or closed state of the locking apparatus, and adapted to be selectively contacted by the release lever stop arm portion, the open-status limit switch including a first resistor, the open-status limit switch being adapted to be contacted by the release lever stop arm portion;

f. a lock-status limit switch for detecting a locked or unlocked state of the locking apparatus, and adapted to be selectively contacted by the latch post, the lock-status limit switch including a second resistor; and, g. a control assembly comprising a programmable logic controller, processor, memory storage and a user interface and in electronic communication with the solenoid, the open-status limit switch and the lock-status limit switch.

5. The system of claim 4, wherein the door is a rollup door.

6. The system of claim 4, wherein the door is a swinging door.

* * * * *